US005153111A

United States Patent [19]

Yoshida et al.

[11] Patent Number: 5,153,111

[45] Date of Patent: Oct. 6, 1992

[54] COMPOSITION FOR COLOR-DEVELOPMENT AND METHOD FOR PROCESSING USING SAME

[75] Inventors: Kazuaki Yoshida; Takatoshi Ishikawa; Tadashi Ogawa; Hiroshi Fujimoto; Junichi Yamanouchi; Tomokazu Yasuda, all of Minami-ashigara, Japan

[73] Assignee: Fuji Photo Film Co., Ltd., Kanagawa, Japan

[21] Appl. No.: 645,447

[22] Filed: Jan. 24, 1991

[30] Foreign Application Priority Data

| | | | |
|---|---|---|---|
| Jan. 24, 1990 | [JP] | Japan | 2-14234 |
| Apr. 3, 1990 | [JP] | Japan | 2-88829 |
| Apr. 10, 1990 | [JP] | Japan | 2-94552 |
| Jul. 6, 1990 | [JP] | Japan | 2-178687 |

[51] Int. Cl.[5] ..... G03C 5/30

[52] U.S. Cl. ..... 430/444; 430/484; 430/485; 430/486; 430/490

[58] Field of Search ..... 430/444, 484, 485, 486, 430/490

[56] References Cited

U.S. PATENT DOCUMENTS

| | | | |
|---|---|---|---|
| 3,552,969 | 1/1971 | Henn et al. | 430/444 |
| 4,801,521 | 1/1989 | Ohki et al. | 430/380 |
| 4,892,804 | 1/1990 | Vincent et al. | 430/490 |
| 4,937,178 | 6/1990 | Koboshi et al. | 430/464 |
| 4,960,684 | 10/1990 | Ishikawa et al. | 430/467 |

FOREIGN PATENT DOCUMENTS

| | | | |
|---|---|---|---|
| 2000118 | 4/1990 | Canada | 430/486 |
| 0270217 | 6/1988 | European Pat. Off. . | |
| 0273986 | 7/1988 | European Pat. Off. . | |
| 0361407 | 4/1990 | European Pat. Off. . | |

OTHER PUBLICATIONS

Patent Abstracts of Japan, vol. 12, No. 25 (P-659)(2872) 26 Jan. 1988, & JP-A-62 178257 (Konishiroku Photo Industry Co. Ltd.) 05 Aug. 1987.

Patent Abstracts of Japan, vol. 9, No. 323 (P-414)(2046) 18 Dec. 1985, & JP-A-60 150050 (Fuji Shashin Film KK) 07 Aug. 1985.

Patent Abstracts of Japan, vol. 7, No. 231 (P-229)(1376) 13 Oct. 1983, & JP-A-58 120250 (Konishiroku Photo Industry Co. Ltd.) 18 Jul. 1983.

Patent Abstracts of Japan, vol. 5, No. 150 (P-81)(822) 22 Sep. 1981, & JP-A-56 81842 (Oriental Shashin Kogyo KK) 04 Jul. 1981.

*Primary Examiner*—Hoa Van Le

*Attorney, Agent, or Firm*—Sughrue, Mion, Zinn, Macpeak & Seas

[57] ABSTRACT

A composition for color-development of a silver halide color photographic material and a method for processing such using the same wherein the composition comprises an aromatic primary amine color developing agent, a hydroxylamine compound represented by formula (I) or a hydrazine compound represented by formula (II) and at least one polymer selected from the group consisting of a vinyl alcohol homopolymer, a vinyl alcohol copolymer, a vinylpyrrolidone homopolymer, and a vinylpyrrolidone copolymer, being free from sulfite ion, providing a color photographic image high in maximum density and good in whiteness without causing problems by tarry substance in the color developer.

19 Claims, No Drawings

COMPOSITION FOR COLOR-DEVELOPMENT AND METHOD FOR PROCESSING USING SAME

FIELD OF THE INVENTION

The present invention relates to a method for processing silver halide color photographic materials. More particularly the present invention relates to a color processing method that prevents stain due to oxidation products of color developing agents and gives a photographic image excellent in whiteness.

BACKGROUND OF THE INVENTION

It is known that color developers containing an aromatic primary amine developing agent autoxidize when they come in contact with air (T. H. James, *The Theory of the Photographic Process,* 4th edition, p. 315 (1979)). As a result the color developer turns dark brown, and further a black tarry contaminant is produced. This black tarry contaminant will stick to the photographic material and become stain after the processing, or it will stick to processor parts in contact with the color developer, such as the processing solution tank, pipelines, and conveying rollers, and will stain heavily the processor when continuous processing is carried out in an automatic processor by supplying the developer. In particular, when parts that come in contact with the photographic material are stained, the stain will be transferred to the photographic material and the commercial value of the photographic material will be lost.

Recently, it has become practiced that color photographic material is subjected to color processing in a short period of time, up to 5 min, under high temperature conditions of 30° C. or higher. This high-temperature color developer is apt to be oxidized by air and is liable to produce the above tarry contaminant. Further, in the field of development processing of color negative film and color paper, development processing using small-sized automatic processors called "mini-labs" is becoming prevalent very quickly. In the "mini-lab" processing, since the processing amount per day is small, the time of the color developer staying in the color developer tank becomes longer and the color developer is in such a state that it is liable to be oxidized by air.

As means of preventing air oxidation of color developers, techniques wherein a compound called a preservative is added to the color developer have been practiced. As preservatives, conventionally compounds such as sulfites and hydroxylamine salts are known (L. F. A. Mason, *Photographic Processing Chemistry,* p. 34 (1966)).

In particular, sulfites are remarkably effective in preventing the coloring of the color developer and the occurrence of a tarry contaminant. However, it is known that, for the high-silver-chloride color photographic materials used recently in quick development processing, it is practically difficult to use sulfites that highly block color formation and highly solubilize silver.

To perform quick development processing and low-replenishment processing wherein a high-silver-chloride photographic material is used, many preservatives in place of sulfites and hydroxylamine salts have been studied. For example, International Publication Patent No. WO 87-04534 discloses a method wherein alkyl-substituted hydroxylamines are used, and JP-A ("JP-A" means unexamined published Japanese patent application) Nos. 170642/1988 and 146041/1988 disclose a method wherein hydrazines and hydrazides are used as preservatives.

It is also known that many compounds known as chelating agents of metal ions have been shown to play an important role in the preservation of developers (Research Disclosure No. 17048, June 1978), and they can be used together with the above preservatives.

Although all of the above compounds have a high effect for suppressing air oxidation of color developers and for keeping photographic performance, they cannot suppress air oxidation completely, which results in the formation of a tarry contaminant that causes various injurious problems. In particular, in low-replenishment processing, since the periods of a color developer and a color developer replenisher staying in the tanks are longer and the pH and the concentration of the developing agent of the color developer replenisher are high, they are in a state liable to be oxidized by air, and therefore development of techniques is desired wherein formation of the above tarry contaminant in color developing agents is prevented or the influence of the contaminant is made unharmful.

SUMMARY OF THE INVENTION

The first object of the present invention is to provide a method for processing a silver halide color photographic material that gives a color photographic image high in maximum density and good in whiteness.

The second object of the present invention is to provide a development processing method that can prevent a color developer from forming a tarry contaminant or that can make unharmful the influence of a contaminant of a color developer.

The third object of the present invention is to provide a method of processing a silver halide color photographic material that can prevent a tarry, contaminant from sticking to parts of a processing machine or an automatic processor (e.g., a processing tank, pipelines, and conveying rollers), which stains them.

The fourth object of the present invention is to provide a method for processing that can obtain a color photographic image excellent in brightness by improving desilvering property.

Other and further objects, features, and advantages of the invention will appear more fully from the following description.

DETAILED DESCRIPTION OF THE INVENTION

The objects of the present invention have been attained by (1) A color developing composition that comprises at least one aromatic primary amine color developing agent, at least one of compounds represented by the below-mentioned formula (I) or (II), and at least one selected from the group consisting of a vinyl alcohol homopolymer, a vinyl alcohol copolymer, a vinylpyrrolidone homopolymer, and a vinylpyrrolidone copolymer, and that is substantially free from sulfite ions:

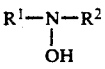

Formula (I)

wherein $R^1$ and $R^2$ each represent a hydrogen atom, an alkyl group, an alkenyl group, an aryl group, or a heteroaromatic group, and $R_1$ and $R_2$ is not hydrogen atoms at the same time and they may bond each other together the nitrogen atom to form a heterocyclic ring,

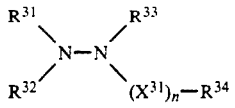

Formula (II)

wherein $R^{31}$, $R^{32}$, and $R^{33}$ each represent a hydrogen atom, an alkyl group, an aryl group, or a heterocyclic group, $R^{34}$ represents a hydroxyl group, a hydroxyamino group, an alkyl group, an aryl group, a heterocyclic group, an alkoxy group, an aryloxy group, a carbamoyl group, or an amino group, and $X^{31}$ represents a bivalent group selected from —CO—, —$SO_2$—,

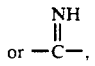

and n is 0 or 1, and (2) A method for processing a silver halide color photographic material, characterized in that a silver halide color photographic material that has been exposed to light imagewise is processed with the color developing composition as claimed in claim (1).

Formula (I) will be described in detail.

$R_1$ and $R_2$ may be further substituted. The heterocyclic ring may be a 5- to 6-membered ring, which may be made up of carbon atoms, hydrogen atoms, halogen atoms, oxygen atoms, nitrogen atoms, sulfur atoms, etc., and which may be saturated or unsaturated.

$R^1$ and $R^2$ preferably each represent an alkyl group or an alkenyl group having preferably 1 to 10 carbon atoms, and more preferably 1 to 5 carbon atoms. As a nitrogen-containing heterocyclic ring formed by bonding $R_1$ and $R_2$, for example, a piperidyl group, a pyrrolidyl group, an N-alkylpiperazyl group, a morpholyl group, an indolinyl group, and a benztriazole group can be mentioned.

Of the compounds represented by formula (I), compounds represented by the below-mentioned formula (I-a) are particularly preferable in view of preventing fluctuation of photographic quality and preventing the above-mentioned streaked fogging.

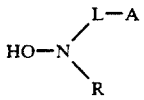

Formula (I-a)

wherein L represents an optionally substituted alkylene group, A represents a carboxy group, a sulfo group, a phosphono group, a phosphinic acid residue, a hydroxyl group, an amino group that may be substituted by an alkyl group, an ammonio group that may be substituted by an alkyl group, a carbamoyl group that may be substituted by an alkyl group, or a sulfamoyl group that may be substituted by an alkyl group, and R represents a hydrogen atom or an optionally substituted alkyl group.

Formula (I-a) will now be described in detail.

In formula (I-a), L represents a linear or branched and optionally substituted alkylene group having 1 to 10, preferably 1 to 5, carbon atoms, and specifically methylene, ethylene, trimethylene, and propylene can be mentioned as preferable examples. The substituent includes a carboxy group, a sulfo group, a phosphono group, a phosphinic acid residue, a hydroxyl group, and an ammonio group that may be substituted by an alkyl group, and preferable examples are a carboxyl group, a sulfo group, a phosphono group, and a hydroxyl group. A represents a carboxy group, a sulfo group, a phosphono group, a phosphinic acid residue, a hydroxyl group, an amino group that may be substituted by an alkyl group, an ammonio group that may be substituted by an alkyl group having preferably 1 to 5 carbon atoms, a carbamoyl group that may be substituted by an alkyl group having preferably 1 to 5 carbon atoms, or a sulfamoyl group that may be substituted by an alkyl group having preferably 1 to 5 carbon atoms, and preferable examples are a carboxyl group, a sulfo group, a hydroxyl group, a phosphono group, and a carbamoyl group that may be substituted by an alkyl group. As preferable examples of -L-A, a carboxymethyl group, a carboxyethyl group, a carboxypropyl group, a sulfoethyl group, a sulfopropyl group, a sulfobutyl group, a phosphonomethyl group, a phosphonoethyl group, and a hydroxyethyl group can be mentioned, with a carboxylmethyl group, a carboxyethyl group, a sulfoethyl group, a sulfopropyl group, a phosphonomethyl group, and a phosphonoethyl group particularly preferable. R represents a hydrogen atom or a linear or branched and optionally substituted alkyl group having 1 to 10, preferably 1 to 5, carbon atoms. The substituent includes a carboxy group, a sulfo group, a phosphono group, a phosphonic acid residue, a hydroxyl group, an amino group that may be substituted by an alkyl group, an ammonio group that may be substituted by an alkyl group, a carbamoyl group that may be substituted by an alkyl group, and a sulfamoyl group that may be substituted by an alkyl group. Two or more such substituents may be present. As preferable examples of R, a hydrogen atom, a carboxymethyl group, a carboxyethyl group, a carboxypropyl group, a sulfoethyl group, a sulfopropyl group, a sulfobutyl group, a phosphonomethyl group, a phosphonoethyl group, and a hydroxyethyl group can be mentioned, with a hydrogen atom, a carboxymethyl group, a carboxyethyl group, a sulfoethyl group, a sulfopropyl group, a phosphonomethyl group, and a phosphonoethyl group more preferable.

Specific examples of the compound of formula (I) in the present invention are listed below, but the present invention is not limited to them.

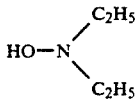

I-1

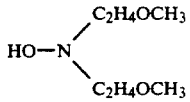

I-2

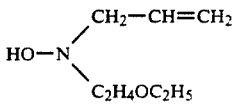

I-3

-continued
I-4
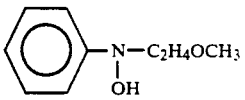
I-5
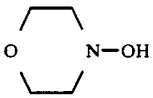
I-6
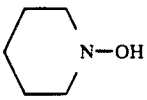
I-7
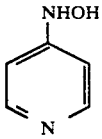
I-8
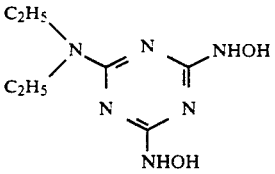
I-9
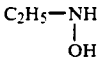
I-10
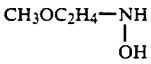
I-11
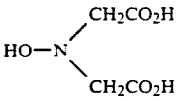
I-12
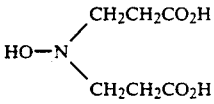
I-13
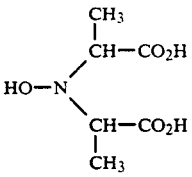
I-14
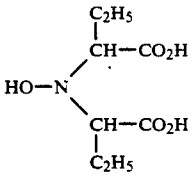
I-15
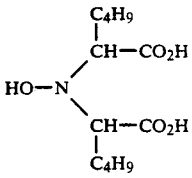
-continued
I-16
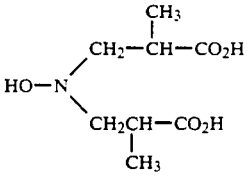
I-17
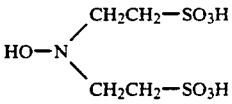
I-18
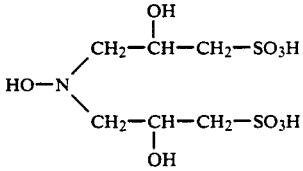
I-19
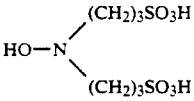
I-20
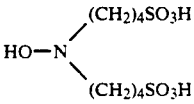
I-21
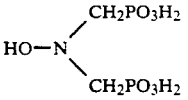
I-22
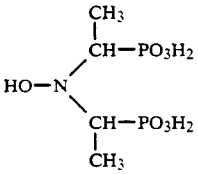
I-23
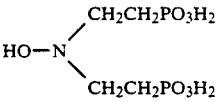
I-24
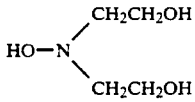
I-25
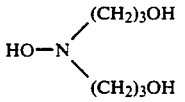
I-26
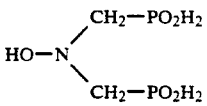
I-27
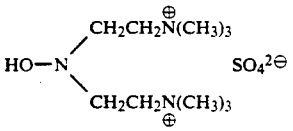

-continued

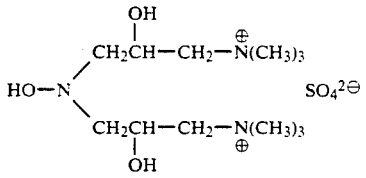
I-28

$HO-NH-CH_2CO_2H$ I-29

$HO-NH-CH_2CH_2CO_2H$ I-30

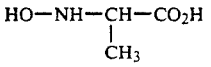
I-31

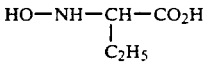
I-32

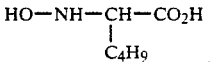
I-33

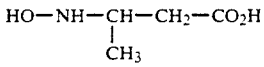
I-34

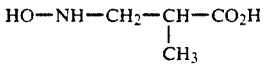
I-35

$HO-NH-CH_2CH_2SO_3H$ I-36

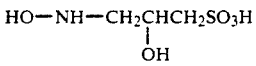
I-37

$HO-NH-(CH_2)_3SO_3H$ I-38

$HO-NH-(CH_2)_4SO_3H$ I-39

$HO-NH-CH_2PO_3H_2$ I-40

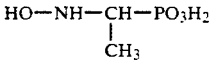
I-41

$HO-NH-CH_2CH_2PO_3H_2$ I-42

$HO-NH-CH_2CH_2OH$ I-43

$HO-NH-(CH_2)_3OH$ I-44

$HO-NH-CH_2-PO_2H_2$ I-45

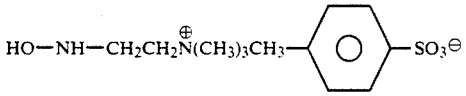
I-46

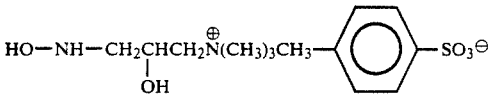
I-47

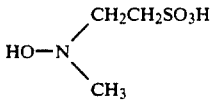
I-48

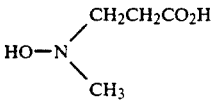
I-49

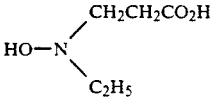
I-50

-continued

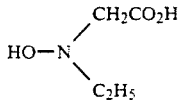
I-51

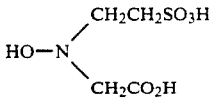
I-52

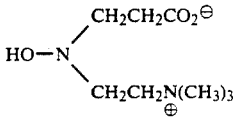
I-53

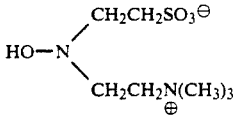
I-54

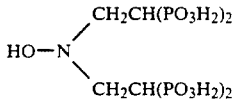
I-55

$HONCH_2CH(PO_3H_3)_2$ I-56

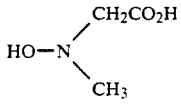
I-57

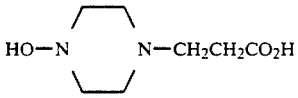
I-58

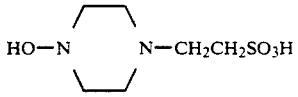
I-59

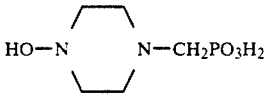
I-60

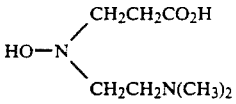
I-61

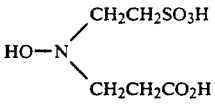
I-62

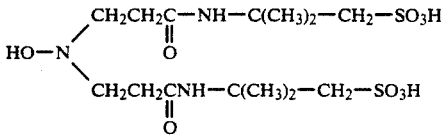
I-63

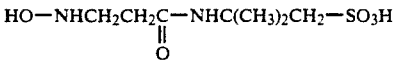
I-64

The compound represented by formula (I) can be synthesized by an alkylation reaction (e.g., a nucleophilic substitution reaction, an addition reaction, and a Mannich reaction) of commercially available hydroxylamines. Although they can be synthesized in accordance with the synthesis processes disclosed, for example, in West German Patent No. 1159634 and *Inorganica Chimica Acta,* 93, (1984), 101–108, specific processes are given below.

SYNTHESIS EXAMPLES

Synthesis Example of Exemplified Compound (I-7)

11.5 g of sodium hydroxide and 96 g of sodium chloroethanesulfonate were added to 200 ml of an aqueous solution containing 20 g of hydroxylamine hydrochloride, and then 40 ml of an aqueous solution containing 23 g of sodium hydroxide was added thereto slowly over 1 hour with the temperature kept at 60° C. The reaction liquid is condensed under reduced pressure over 3 hours with the temperature kept at 60° C., 200 ml of concentrated hydrochloric acid was added, and it was heated to 50° C. The insoluble matter was filtered, and 500 ml of methanol was added to the filtrate to obtain the intended product (Exemplified Compound I-7) in the form of monosodium salt crystals. 41 g (yield: 53%)

Synthesis Example of Exemplified Compound (I-21)

32.6 g of formalin was added to an aqueous hydrochloric acid solution containing 7.2 g of hydroxylamine hydrochloride and 18.0 g of phosphorous acid and the mixture was heated for 2 hours under reflux. The produced crystals were recrystallized from water and methanol, to obtain 9.2 g (42%) of Exemplified Compound (I-12).

Formula (II) will now be described in detail.

In formula (II), $R^{31}$ to $R^{34}$ each may have a substituent. As the heterocyclic ring represented by $R^{31}$ to $R^{33}$, a 5- to 6-membered one is preferable, which is made up of those selected from C, H, O, N, S and halogen atoms, and it may be saturated or unsaturated.

When n=0, $R^{34}$ represents a group selected from an alkyl group, an aryl group, and a heterocyclic group, and $R^{33}$ and $R^{34}$ may form cooperatively a heterocyclic ring.

In formula (II), $R^{31}$, $R^{32}$, and $R^{33}$ each represent preferably a hydrogen atom or an alkyl group having 1 to 10 carbon atoms, and most preferably $R^{31}$ and $R^{32}$ each represent a hydrogen atom.

In formula (II), $R^{34}$ represents preferably an alkyl group, an aryl group, an alkoxy group, a carbamoyl group, or an amino group, and particularly preferably an alkyl group or a substituted alkyl group. Preferable substituents of the alkyl group are, for example, a carboxyl group, a sulfo group, a nitro group, an amino group, and a phosphono group. $X^{31}$ represents preferably —CO— or —$SO_2$—, and most preferably —CO—.

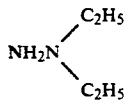
II-1

$NH_2NH(CH_2)_4SO_3H$ II-2

$NH_2NH(CH_2)_2OH$ II-3

-continued

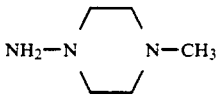
II-4

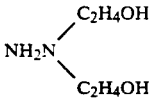
II-5

$NH_2NHCOCH_3$ II-6

$NH_2NHCOOC_2H_5$ II-7

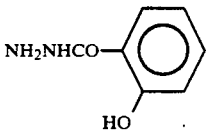
II-8

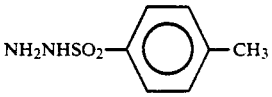
II-9

$NH_2NHCONH_2$ II-10

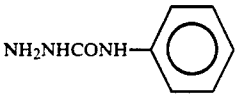
II-11

$NH_2NHSO_3H$ II-12

$NH_2NHC(=NH)NH_2$ II-13

$NH_2NHCOCONHNH_2$ II-14

$NH_2NHCH_2CH_2CH_2SO_3H$ II-15

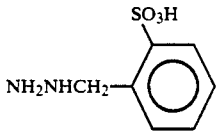
II-16

$NH_2NHCH(C_4H_9(n))COOH$ II-17

$NH_2NHCH_2CH_2COOH$ II-18

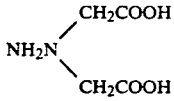
II-19

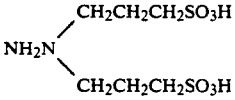
II-20

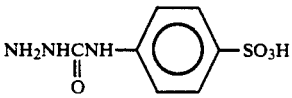
II-21

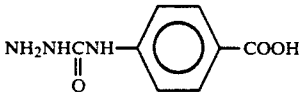
II-22

Preferably the amount of the above compound to be added to a color developer is 0.005 mol/l to 0.5 mol/l, and more preferably 0.03 mol/l to 0.1 mol/l.

The polymerization degree of said polymer used in the present invention is preferably 100 to 5,000 more preferably 200 to 2,000.

Although there is no particular limit to the molecular weight of said polymer used in the present invention, preferable polymers are those having a molecular weight on the order of 1,000 to 50,000. When vinyl alcohol or vinyl pyrrolidone are used in the form of a copolymer, as compounds to be copolymerized therewith, for example, acryl esters, acrylamide, ethyleneimine, vinylpyridine, styrene, vinylmethylimidazole, acrylic acid, methacrylic acid, maleic anhydride, maleic acid, styrenesulfonic acid, vinylbenzoic acid, phenol, polyesters, silicon, vinylsuccinimide, acrylonitrile, vinyl esters, arylates, vinyl alcohol, and vinylpyrrolidone can be mentioned, but the present invention is not limited to them if the copolymer contains 20 mol % or more of vinyl alcohol or vinylpyrrolidone.

Preferable copolymers are those containing vinyl alcohol or vinylpyrrolidone in an amount of 40 mol % or more, more preferably in particular of 70 mol % or more and desirably these copolymers are substantially soluble in water. In the present invention, a copolymer or a homopolymer of these compounds is preferable. Polymers of vinylpyrrolidone are more preferable for the purpose of the present invention.

Preferable specific examples of said polymer are given below, but the present invention is not limited to them:

III-1 polyvinyl alcohol
III-2 polyvinyl alcohol/vinyl acetate copolymer
III-3 vinyl alcohol/acrylic acid copolymer
III-4 vinyl alcohol/vinylpyrrolidone copolymer
III-5 vinyl alcohol/methacrylic acid copolymer
III-6 vinyl alcohol/maleic acid copolymer
III-7 vinyl alcohol/acrylonitrile copolymer
III-8 vinyl alcohol/acrylate copolymer
III-9 vinyl alcohol/acrylate/acrylic acid copolymer
III-10 polyvinylpyrrolidone
III-11 vinylpyrrolidone/acrylate copolymer
III-12 vinylpyrrolidone/vinyl acetate copolymer
III-13 vinylpyrrolidone/methacrylic acid copolymer
III-14 vinylpyrrolidone/maleic acid copolymer
III-15 vinylpyrrolidone/acrylamide copolymer
III-16 vinylpyrrolidone/methacrylamide copolymer
III-17 vinylpyrrolidone/acryl acid copolymer
III-18 vinylpyrrolidone/acrylate/acrylic acid copolymer
III-19 vinylpyrrolidone/vinyl alcohol/acrylic acid copolymer
III-20 vinylpyrrolidone/vinyl alcohol/acrylate copolymer Preferably the amount of the above compound to be added to the color developer is 0.05 g/l to 2 g/l, and more preferably 0.1 g/l to 1 g/l.

In the present invention the color developer is substantially free from sulfite ions, and the expression "substantially free from sulfite ions" means that sulfite ions are in an amount of $5.0\times10^{-3}$ mol/l or less. Particularly preferably the color developer does not contain sulfite ions at all in the case wherein a high-silver-chloride color photographic material having a silver chloride content of 80 mol % or more is subjected to color processing in view of color formation and process stability. In the present invention, however, a very small amount of sulfite ions used for the prevention of oxidation of the processing agent kit in which a developing agent is condensed before it is adjusted to be a tank solution is excluded from consideration. The above polymer is also used for parts of neutral pH and parts of acid pH of the processing agent kit. Herein, the polymer is desirably at a pH at which it can dissolve even if it is in a high concentration.

The inventors have investigated in various ways for the purpose of preventing a color developer from turning colored and forming a black tarry contaminant and for the purpose of making the coloration and the contaminant unharmful, and as a result we have attained the purposes by using a compound of formula (I) or (II) in combination with a homopolymer or a copolymer of vinyl alcohol or vinylpyrrolidone, even in the absence of sulfite ions, and we have found a quick and low-replenishment processing method for processing a high-silver-chloride color photographic material in which the maximum density is high, the white background is excellent, and a contaminant is not formed.

Although the compounds represented by formulae (I) and (II) are described as preservatives for developing agents in International Publication Patent No. WO 87-04534 and JP-A Nos. 146041/1988 and 170642/1986, their effect for preventing the above color developer from turning colored and forming a tarry contaminant was inadequate.

If the above polymer of the present invention was used alone, the effect for preventing the above color developer from turning colored and forming a tarry contaminant was not exhibited at all, and when the above polymer of the present invention was used in combination with a preservative other than those of the present invention, such an effect could not been obtained.

The effect obtained by the above combination is very unique, having not been expected at all, and is very surprising.

JP-B ("JP-B" means examined Japanese patent publication) No. 20743/1972 describes the addition of the polymer of the present invention to a color developer. However, that addition is intended to prevent the color developer from depositing crystals, the process of the publication is carried out in the absence of compounds of formulae (I) and (II) and in the presence of sulfite ions, and the publication describes, for example, neither problems involved in the use of high-silver-chloride photographic materials nor measures of solving such problems as are taken up in the present invention.

The color developer used in the present invention will now be described.

In the present invention, the combination of a compound of formula (I) and (II) with another preservative is preferable in that the processing solution is stabilized and the processing stability in continuous processing is improved.

As preferable preservatives can be mentioned hydroxamic acids, phenols, α-hydroxyketones, α-aminoketones, saccharides, monoamines, diamines, polyamines, quaternary ammonium salts, nitroxy, radicals, alcohols, oximes, diamide compounds, and condensed ring-type amines. They are disclosed, for example, in JP-A Nos. 147823/1986, 173595/1986, 165621/1986, 186559/1986, 170756/1986, 188742/1986, and 188741/1986, U.S. Pat. Nos. 3,615,503 and 2,494,903, JP-A No. 143020/1987, and JP-B No. 30496/1973.

Among these, compounds represented by formula (IV) are preferable to use in combination with a compound represented by formula (I) or (II).

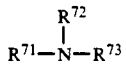

Formula (IV)

wherein $R^{71}$, $R^{72}$, and $R^{73}$, each represent a hydrogen atom, an alkyl group, an alkenyl group, an aryl group, an aralkyl group or a heterocyclic group, and $R^{71}$ and $R^{72}$, $R^{71}$ and $R^{73}$, or $R^{72}$ and $R^{73}$ may bond together to form a nitrogen-containing heterocyclic group.

$R^{71}$, $R^{72}$, and $R^{73}$ may have substituent. Particularly preferably $R^{71}$, $R^{72}$, and $R^{73}$ each represent a hydrogen atom or an alkyl group. As a substituent can be mentioned, for example, a hydroxyl group, a sulfo group, a carboxyl group, a halogen atom, a nitro group, and an amino group.

Exemplified compounds:

$N(CH_2CH_2OH)_3$ IV-1

$H_2NCH_2CH_2OH$ IV-2

$HN(CH_2CH_2OH)_2$ IV-3

$C_7H_{15}N(CH_2CH(OH)CH_2OH)_2$ IV-4

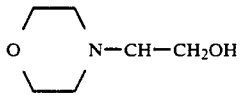

IV-5

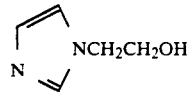

IV-6

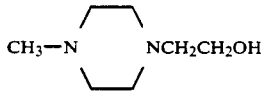

IV-7

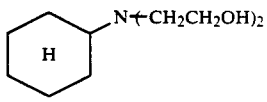

IV-8

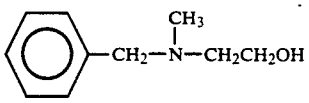

IV-9

$(HOCH_2CH_2)_2NCH_2CH_2SO_2CH_3$ IV-10

$NH(CH_2COOH)_2$ IV-11

$HOOCCH_2CH_2CH(NH_2)COOH$ IV-12

$H_2NCH_2CH_2SO_2NH_2$ IV-13

$(C_2H_5)_2N-CH_2CH_2OCH_2CH_2OH$ IV-14

$H_2N-C(CH_2OH)_2$ IV-15

-continued $HOCH_2CH(NH_2)COOH$ IV-16

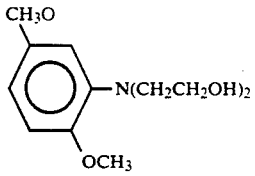

IV-17

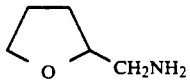

IV-18

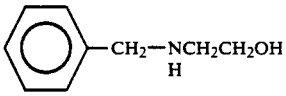

IV-19

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine

D-2: 2-amino-5-diethylaminotoluene

D-3: 2-amino-5-(N-ethyl-N-laurylamino)toluene

D-4: 4-[N-ethyl-N-(β-hydroxyethyl)amino]aniline

D-5: 2-methyl-4-[N-ethyl-N-(β-hydroxyethyl-)amino]aniline

D-6: 4-amino-3-methyl-N-ethyl-N-[β-(methanesulfonamido)ethyl]-aniline

D-7: N-(2-amino-5-diethylaminophenylethyl)methanesulfonamide

D-8: N,N-dimethyl-p-phenylenediamine

D-9: 4-amino-3-methyl-N-ethyl-N-methoxyethylaniline

D-10: 4-amino-3-methyl-N-ethyl-N-β-ethoxyethylaniline

D-11: 4-amino-3-methyl-N-ethyl-N-β-butoxyethylaniline

Of the above-mentioned p-phenylenediamine derivatives, 4-amino-3-methyl-N-ethyl-N-[β-(methanesulfonamido)ethyl]-aniline (exemplified compound D-6) and 2-methyl-4-[N-ethyl-N-(β-hydroxyethyl)amino]-aniline (exemplified compound D-5) are particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 15 g, per liter of developer.

In the color-developer according to the present invention, a compound represented by formulae (B-I) and (B-II) shown below is more preferably used in view of restraint of deterioration of the developer.

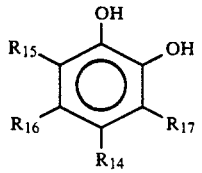

Formula (B-I)

-continued

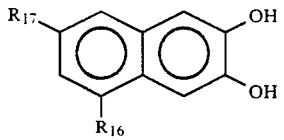

Formula (B-II)

wherein $R_{14}$, $R_{15}$, $R_{16}$, and $R_{17}$, each represent a hydrogen atom, a halogen atom, a sulfonic group, an alkyl group having 1 to 7 carbon atoms, $—OR_{18}$, $—COOR_{19}$,

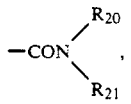

or phenyl group; and $R_{18}$, $R_{19}$, $R_{20}$, and $R_{21}$ each represent a hydrogen atom, an alkyl group having 1 to 18 carbon atoms, provided that when $R_{15}$ represents —OH or a hydrogen atom, $R_{14}$ represents a halogen atom, sulfonic group, an alkyl group having 1 to 7 carbon atoms, $—OR_{18}$, $—COOR_{19}$,

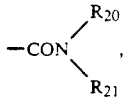

or a phenyl group.

Alkyl group represented by the above-described $R_{14}$, $R_{15}$, $R_{16}$, and $R_{17}$ include those having a substituent, and examples thereof that can be mentioned include, for example, methyl group, ethyl group, isopropyl group, n-propyl group, t-butyl group, n-butyl group, hydroxymethyl group, hydroxyethyl group, methylcarbonic acid group, and benzyl group. Alkyl group represented by $R_{18}$, $R_{19}$, $R_{20}$, and $R_{21}$, has the same meaning as the above and further octyl group can be included.

As phenyl group represented by $R_{14}$, $R_{15}$, $R_{16}$, and $R_{17}$ phenyl group, 2-hydroxyphenyl group, and 4-amino-phenyl group can be mentioned.

Representative examples of the chelating agent of the preset invention are shown below, but the invention is not limited to them.

(B-I-1): 4-isopropyl-1,2-dihydroxybenzene
(B-I-2): 1,2-dihydroxybenzene-3,5-disulfonic acid
(B-I-3): 1,2,3-trihydroxybenzene-5-carbonic acid
(B-I-4): 1,2,3-trihydroxybenzene-5-carboxymethyl ester
(B-I-5): 1,2,3-trihydroxybenzene-5-carboxy-n-butyl ester
(B-I-6): 5-t-butyl-1,2,3-trihydroxybenzene
(B-I-7): 1,2-dihydroxybenzene-3,4,6-trisulfonic acid
(B-II-1): 2,3-dihydroxynaphthalene-6-sulfonic acid
(B-II-2): 2,3,8-trihydroxynaphthalene-6-sulfonic acid
(B-II-3): 2,3-dihydroxynaphthalene-6-carbonic acid
(B-II-4): 2,3-dihydroxy-8-isopropyl-naphthalene
(B-II-5): 2,3-dihydroxy-8-chloro-naphthalene-6-sulfonic acid Of the above-mentioned compounds, one that can be used preferably in particular in the present invention is 1,2-dihydroxybenzene-3,5-disulfonic acid, which may be used as the form of alkaline salt such as sodium salt and potassium salt (exemplified compound (B-I-2)).

In the present invention, compound represented by the above formulae (B-I) or (B-II) may be used in the range of 5 mg to 15 g, preferably 15 mg to 10 g, more preferably 25 mg to 7 g, per liter of color developer.

Preferably the pH of the color developer of the present invention is in the range of 9 to 12, more preferably 9 to 11.0, and other known compounds that are components of a conventional developing solution can be contained.

In order to keep the above pH, it is preferable to use various buffers. As buffers, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. Specific examples are shown below, but the present invention is not limited to them: nitrilotriacetic acid, diethylenediaminepentaacetic acid, ethylenediaminetetraacetic acid, triethylenetetraminehexaacetic acid, nitrilo-N,N,N-tris(methylenephosphonic acid), ethylenediamine-N,N-N',N'-tetrakis(methylenesulfonic acid), 1,3-diamino-2-propanoltetraacetic acid, transcyclohexanediaminietetraacetic acid, nitrilotripropionic acid, 1,2-diaminopropanetetraacetic acid, hydroxyethyliminodiacetic acid, glycol ether diaminetetraacetic acid, hydroxyethylenediaminetriacetic acid, ethylenediamine-ortho-hydroxyphenyltetraacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid, and 4-sulfosalicylic acid.

Of these chelating agents, ethylendiaminetetraacetic acid, diethylenediaminepentaacetic acid, triethylenetetraminehexaacetic acid, 1-3-diamino-2-propanoltetraacetic acid, ethylenediamine-N,N,N',N'-tetrakis(methylenephosphonic acid), and hydroxyiminodiacetic acid are preferably used.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; p-aminophenols disclosed, for example, in U.S. Pat. Nos. 2,610,122 and 4,119,462; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, mesoionic type compounds, ionic type compounds, and imidazoles.

It is preferable that the color developer of the present invention is substantially free from benzyl alcohol in view of prevention of edge stain. Herein the term "substantially free from" means that the amount of benzyl alcohol is 2.0 ml or below per liter of the developer, or preferably benzyl alcohol is not contained in the developer at all. It is particularly preferable to be substantially free from benzyl alcohol to obtain better result in which the change of photographic property, particularly, the increase of stain is little.

In the present invention, if necessary, any antifoggant can be added in addition to chloride ion and bromide ion. As antifoggants, use can be made of alkali metal halides, such as potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2thiazolyl-benzimidazole, 2-thiazolylmethyl-benzimidazole, indazole, hydroxyazaindolizine, and adenine.

For the purpose of preventing fogging or the like, particularly in the processing a high-silver-chloride photographic material containing 80 mol % or over of silver chloride, it is preferable that chloride ions and bromide ions exist in the color developer in an amount of $3.0\times10^{-2}$ to $1.5\times10^{-1}$ mol/l and $3.5\times10^{-5}$ to $1\times10^{-3}$ mol/l, respectively.

It is preferable that the color developer used in the present invention contains a brightening agent. As the brightening agent, 4,4'-diamino-2,2'-disulfostilbene compounds are preferable, which will be added in an amount of 0 to 10 g/l, preferably 0.1 to 6 g/l.

If required, various surface-active agents, such as alkylsulfonic acids, arylphosphonic acids, aliphatic carboxylic acids, and aromatic carboxylic acids may be added.

The processing time of the color developer for use in the present invention may be, for example, 10 to 120 sec., preferably 20 to 60 sec., in which effects of the present invention are remarkable. The processing temperature is 33° to 45° C., and preferably 36° to 40° C., under such conditions the effect of the present invention is particularly remarkable.

The amount of the replenisher of the color developer during continuous processing is 20 to 220 ml, preferably 25 to 160 ml, and particularly preferably 30 to 110 ml, per 1 $m^2$ of the photographic material, which is preferable because the effect of the present invention can be exhibited efficiently.

The color developer of the present invention has relatively better performance than that obtained by combinations other than the combination of the present invention, even if the opened surface ratio of the color developer (the air contact surface area ($cm^2$)/the solution volume ($cm^3$)) is in any state. Preferably the opened surface ratio is 0 to 0.1 $cm^{-1}$ in view of the stability of the color developer. In the continuous processing, preferably, in practice, the opened surface ratio is in the range of 0.001 to 0.05 $cm^{-1}$, more preferably 0.002 to 0.03 $cm^{-1}$.

Generally when hydroxylamine or the like is used as a preservative, it is widely known that even if the liquid opening rate of the color developer is made small, decomposition of the color developer due to heat or trace metals takes place. However, in the present color developer, such decomposition is very little, and the color developer can be stored for a long period of time or can practically be well used continuously for a long period of time without difficulty. Therefore, in such a case, preferably the opened surface ratio is smaller, and most preferably the opened surface ratio is 0 to 0.002 $cm^{-1}$.

Conversely, there is a method wherein a large opened surface ratio is used, provided that after a certain amount of a photographic material is processed, the processing solution is discarded, and even in such a processing method, the constitution according to the present invention can exhibit excellent performance.

In the present invention desilvering is effected after color development. Alternatively, after color development water-washing may be effected, and then desilvering may be effected. Further, when fixing is effected after bleaching, water-washing may be affected between the bleaching step and the fixing step, if necessary. In particular, preferably the above-mentioned water-washing may be carried out, in the case of regeneration treatment of fixing solution. Although the desilvering step generally consists of a bleaching step and a fixing step, particularly preferably the both steps are carried out simultaneously.

In the bleaching solution or bleach-fixing solution of the present invention, an aminopolycarboxylic acid-iron complex is used as a bleaching agent. Aminopolycarboxylic acids to be useful preferably are shown below, but the invention is not limited to them.

A-1 Methyliminodiacetic acid
A-2 Iminodiacetic acid
A-3 Ethylenediaminetetraacetic acid
A-4 Diethylentriamineheptaacetic acid
A-5 Glycoletherdiaminetetraacetic acid
A-6 Cyclohexanediaminetetraacetic acid
A-7 1,3-Propanediaminetetraacetic acid
A-8 1,4-Butanediaminetetraacetic acid
A-9 Hydroxyethylethylenediaminetriacetic acid These bleaching agents can be used in combination with each other, if necessary. The amount of bleaching agent to be used is preferably to be small for preventing environmental pollution, and is preferably 0.01 to 0.2 mol, more preferably 0.02 to 0.1 mol, per liter of bleaching solution or bleach-fixing solution.

Although the above-mentioned bleaching agents are generally used in the form of iron (III) complex in the present invention, particularly preferably iron (II) complex is contained in a ratio of 3 to 35% of total iron complex, in view of the improvement of whiteness. When the ratio of iron (II) complex is in the above range, stain (tarr adhered and color remaining ratio) originated from color development is further reduced. More preferably, iron (II) complex consists of 10 to 30% of total iron complex.

To get the composition having the above ratio iron (III) complex and iron (II) complex may be mixed as the above ratio, or only iron (III) complex may be added, followed by partially reduction to iron (II) complex. As reduction process can be mentioned a method of adding such reducing reagent as sulfite and ascorbic acid, a method to control iron (II) formed by bleaching using aeration, and a method to keep iron (II) complex concentration at a somewhat higher level by reusing overflowed solution after processing (regeneration use). Among these, method to control iron (II) concentration by aeration or regeneration is most preferable embodiment because of being easy and cheap method. In the regeneration, bleaching solutions from other processing process can be regenerated in combined together.

Further, the bleaching solution or the bleach-fixing solution used in the present invention can contain rehalogenation agents, such as bromides (e.g., potassium bromide, sodium bromide, and ammonium bromide), chlorides (e.g., potassium chloride, sodium chloride, and ammonium chloride), or iodides (e.g., ammonium iodide).

In the bleaching solution or the bleach-fixing solution relating to the present invention, various compounds may be used as a bleach accelerating agent. Examples of useful bleach accelerating agent are described in the following specification of patent: compounds having a mercapto group or a disulfido bond described in U.S. Pat. No. 3,893,858, German Patent No. 1,290,812, and JP-A No. 95630/1978, thiazoline derivatives described in JP-A No. 140129/1975, thiourea compounds described in U.S. Pat. No. 3,706,561, polyoxiethylene compounds described in German Patent No. 2,748,430, and polyamine compounds described in JP-B No. 8836/1970.

The fixing agent used in the bleach-fixing solution or the fixing solution relating to the present invention includes known fixing agents, for example, thiosulfates such as sodium thiosulfate and ammonium thiosulfate, thiocyanates, such as sodium thiocyanate and ammonium thiocyanate, thioether compounds such as ethylenebisthioglycolic acid and 3,6-dithia-1,8-octanediol, and water-soluble silver halide solvents such as thiourea, and use can be made one or mixture of two or more of them. Further, a special bleach-fixing solution comprising a combination of a fixing agent and a large amount of silver halide such as silver iodide, as described in JP-A No. 155354/1980, can be used. In the present invention, preferably thiosulfates and particularly ammonium thiosulfate can be used. The amount of the fixing agent per liter is preferably 0.3 to 2 mol, more preferably in the range of 0.5 to 1.0 mol.

The bleach-fixing solution or the fixing solution used in the present invention contains, as a preservative, compounds that release sulfite ion, such as sulfites (e g., sodium sulfite, potassium sulfite, and ammonium sulfite), bisulfites (e.g., ammonium bisulfite, sodium bisulfite, and potassium bisulfite), and methabisulfites (e.g., potassium methabisulfite, sodium methabisulfite, and ammonium methabisulfite). Preferably these compounds are contained in an amount of about, 0.02 to 0.60 mol per liter, and more preferably 0.04 to 0.40 mol per liter, in terms of sulfite ions. In particular, the addition of ammonium sulfite is preferable.

As a preservative, generally a sulfite is added, but other compounds, such as ascorbic acid, carbonyl bisulfite addition compound, sulfinic acids, or carbonyl compounds, may be added.

In the present invention, preferably the pH of the bleach-fixing solution or the fixing solution is in a range of 4 to 6.5, and more preferably 5 to 6, in view of the improvement of whiteness.

It is considered that, when pH is kept in the above-mentioned range, the whiteness is improved by easily removing of stain (tarr adhered and remaining color) originated from the processing.

To adjust pH, according to necessary, hydrochloric acid, sulfuric acid, nitric acid, acetic acid, bicarbonate, ammonia, caustic potassium, caustic sodium, sodium carbonate, and potassium carbonate can be added.

In the present invention, the processing time by fixing solution or bleach-fixing solution may be 10 to 120 sec and preferably 20 to 60 sec. And the replenishing amount may be 20 to 250 ml, preferably 30 to 250 ml, per $m^2$ of photographic material.

Preferably, the pH of bleaching solution may be 0.1 to 7, particularly preferably 1.0 to 6.0. The time in bleaching bath may be 10 sec. to 2 min, preferably 30 sec. to 100 sec., and the processing temperature may be 25° C. to 40° C. The replenishing amount may be 30 to 500 ml, preferably 50 to 300 ml, per $m^2$ of photographic material.

Additionally, the bleach-fixing solution, the bleaching solution, or the fixing solution may contain various fluorescent brightening agents, antifoaming agents, surface-active agents, or organic solvents such as polyvinylpyrrolidone.

If required, one or more of inorganic or organic acids or alkaline metal or ammonium salts thereof that has a pH-buffering property, such as, boric acid, borax, sodium methaborate, acetic acid, sodium acetate, potassium carbonate, phosphorous acid, phosphoric acid, sodium phosphate, citric acid, sodium citrate, and tartaric acid, or corrosion preventing agents such as ammonium nitrate or guanidine can be contained.

Further, chelating agents or anti-mold agents may be added, according to needs.

In the present invention, the bleach-fixing solution, the bleaching solution, or the fixing solution can be reuse after regeneration. Reuse is preferable in view of reducing the volume of waste solution.

In the present invention, method for regeneration and reuse of bleach-fixing solution or bleaching solution is preferably to reuse solution which has been additionally added insufficient chemicals (e.g., generally, bleaching agent, halide compound and acid) to the overflowed solution generated in the processing and stored until a prescribed volume, as replenisher, but it is not limited to this method. Tank solution or stocked solution may be subjected to aeration.

The reuse of fixing solution after desilvering may be a most preferable embodiment in the present invention. Although the method for desilvering method is selected from a method using steel-wool described in JP-A No. 3624/1973 and U.S. Pat. No. 4,065,313, an electrolysis-method described in U.S. Pat. Nos. 4,014,764 and 4,036,715, JP-B No. 40491/1978, and JP-A No. 23245/1986, and a dilution-method described in JP-B No. 33697/1981, the electrolysis-method is particularly preferable to use. Desilvering can be effected to tank solution by providing the apparatus, or stocked solution of overflow. Although the generation method of fixing solution may be preferable to reuse solution which has been added insufficient chemicals (e.g., generally, fixing agent, preservative, and pH-adjusting agent) to the overflowed solution after desilvering as replenisher, but the invention is not limited to this. Further, a method for desilvering and regeneration of solution combined with other used fixing solution may be a preferable embodiment in view of shortening time and number of regeneration.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955).

According to the multi-stage countercurrent system, the amount of washing water can be reduced considerably. But a problem arises in that bacteria can propagate due to the increase in the residence time of the water in the tanks, and the suspended matter produced will adhere to the photographic material. To solve such a problem in processing the color photographic material of the present invention, the process for reducing calcium and magnesium described in JP-A No. 288838/1987 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku, Biseibutsu no Genkin, Sakkin, Bobai Gijutsu* (edited by Eiseigijutsu-kai), and *Bokin Bobai-zai Jiten* (edited by Nihon Bokin Bobai-gakkai), can be used.

The pH range of the washing water in the processing steps for the photographic material of the present invention may be 4 to 9, preferably 5 to 8. The temperature and time of washing, which can be set according to the use or property of the photographic material, is generally in the range 15° to 45° C. and 20 sec. to 2 min., preferably 25° to 40° C. and 30 sec. to 1 min.

According to the present invention good photographic properties without the increasing of stain can be obtained even if processing by such short-time washing.

Further, the photographic materials of the present invention can be processed directly by a stabilizing solution without a washing step. In such a stabilizing process, all known methods described, for example, in JP-A Nos. 8543/1982, 14834/1983, 184343/1984, 220345/1985, 238832/1985, 239784/1985, 239749/1985, 4045/1986, and 118749/1986 can be used. A preferred inclusion is to use a stabilizing bath containing 1-hydroxyethylidene-1,1-diphosphonate, 5-chloro-2-methyl-4-isothiazolone-3-one, a bismuth compound, or an ammonium compound.

In some cases a stabilizing process is carried out following the above-described washing process, and an example of such cases is a stabilizing bath containing formalin and a surface-active agent for use as a final bath for color photographic materials for photographing.

The time of the processing steps of the present invention is defined as the period from the time when the photographic material is brought in contact with the color developer to the time when the photographic material leaves the final bath (which is generally a washing bath or a stabilizing bath), and the effect of the present invention can be exhibited remarkably in rapid processing steps wherein the time of those processing steps is 3 min 30 sec or below, preferably 3 min or below.

Now the color photographic material to be used in the present invention will be described in detail.

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called color couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

The silver halide emulsion to be used in the present invention is more preferably, in a rapid and low amount replenishing processing, one having a composition of 80 mol % or more of silver chloride and being substantially free from silver iodide. Herein the term "substantially free from silver iodide" means that the silver iodide content in 1 mol % or below, and preferably 0.2 mol % or below. When the silver chloride content in lower or the silver iodide content is higher than the above-mentioned, rapid processing in impossible because of the developing speed being slow. Therefore, a higher silver chloride content is preferable. That is, 90 mol % or more is preferably, and 95 mol % or more is more preferably. Further, a silver halide emulsion that has silver chloride content still increased is preferably employed for reducing the replenishing amount. In such a case, 98 to 99.9 mol % of silver chloride content such as almost pure silver chloride is also preferably used. However, when a pure silver chloride is used, in some cases there may be caused disadvantages with respect to sensitivity and prevention of pressure marks.

Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used.

To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary due to the formation of mixed crystals caused by the difference in composition, or it may have positively varied continuous structures.

In these high-silver-chloride emulsions, the structure is preferably such that the silver bromide localized phase in the layered form or nonlayered form is present in the silver halide grain and/or on the surface of the silver halide grain as mentioned above. The silver bromide content of the composition of the above-mentioned localized phase is preferably at least 10 mol %, and more preferably over 20 mol %. The localized phase may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In the present invention, the coating amount of silver halide is preferably 0.75 $g/m^2$ or less in terms of silver in view of processing-rapidness and processing-stability. A coating amount of $0.70 \sim 0.40$ $g/m^2$ is more preferable and $0.65 \sim 0.45$ $g/m^2$ is most preferable.

The average grain size of the silver halide grains contained in the silver halide emulsion used in the present invention (the diameter of a circle equivalent to the projected area of the grain is assumed to ba the grain size, and the number average of grain sizes is assumed to be an average grain size) is preferably 0.1 to 2 $\mu$m.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chloromide emulsion used in the present invention can be prepared by methods described, for example, by P. Glafkides, *in Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in "Heterocyclic compounds—Cyanine dyes and related compounds" (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

In the silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface-sensitive emulsion, wherein a latent image is formed mainly on the grain surface, or of a so-called internal-image emulsion, wherein a latent image is formed mainly within the grains.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers, magenta couplers, and yellow couplers preferably used in combination with the coupler of the present invention are those represented by the following formulae (C-I), (C-II), (M-I), (M-II), and (Y):

Formula (C-I)

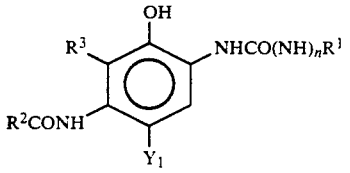

Formula (C-II)

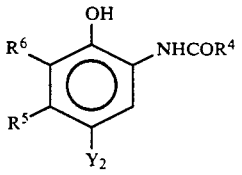

Formula (M-I)

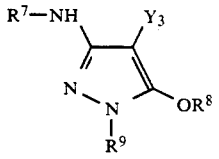

Formula (M-II)

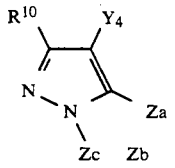

Formula (Y)

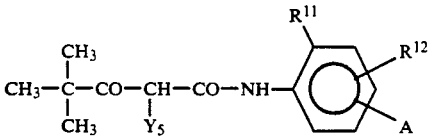

In formulae (C-I) and (C-II), $R^1$, $R^2$, and $R^4$ each represent a substituted or unsubstituted aliphatic, aromatic, or heterocyclic group, $R^3$, $R^5$, and $R^6$ each represent a hydrogen atom, a halogen atom, an aliphatic group, an aromatic group, or an acylamino group, $R^3$ and $R^2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R^5$ preferably represents an aliphatic group such as a methyl group, an ethyl group, a propyl group, a butyl group, a pentadecyl group, a tertbutyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) ar given below:

In formula (C-I), preferable $R^1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R^3$ and $R^2$ together do not form a ring, $R^2$ is preferably a substituted or unsubstituted alkyl group, or aryl group, and particularly preferably an alkyl group substituted by a substituted aryloxy, and preferably $R^3$ represents a hydrogen atom.

In formula (C-II), preferable $R^4$ is a substituted or unsubstituted alkyl group or aryl group, and particularly preferably an alkyl group substituted by a substituted aryloxy group.

In formula (C-II), preferable $R^5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R^5$ is an alkyl group having 2 to 15 carbon atoms, and particularly preferably an alkyl group having 2 to 4 carbon atoms.

In formula (C-II), preferable $R^6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R^7$ and $R^9$ each represent an aryl group, $R^8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R^7$ and $R^9$ are the same substituents as those acceptable to the substituent $R^1$, and if there are two substituents, they may be the same or different. $R^8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R^{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N—, or —NH—, and one of the Za—Zb bond and the Zb—Zc bond is a double bond, and the other is a single bond. If the Zb—Zc bond is a carbon-carbon double bond, it may be part of the aromatic ring. A dimer or more higher polymer formed through $R^{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4] triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R^{11}$ represents a halogen atom, an alkoxy group, a trifluoromethyl group, or an aryl group, and $R^{12}$ represents a hydrogen atom, a halogen atom, or an alkoxy group. A represents $-NHCOR^{13}$, $$-NHSO_2-\underset{\underset{R^{13}}{|}}{R^{13}},$$

$-SO_2NHR^{13}$, $-COOR^{13}$, or $$-SO_2\underset{\underset{R^{14}}{|}}{N}-R^{13},$$

wherein $R^{13}$ and $R^{14}$ each represent an alkyl group, an aryl group, or an acyl group. $Y_5$ represents a coupling split-off group. Substituents of $R^{12}$, $R^{13}$, and $R^{14}$ are the same as those acceptable to $R^1$, and the coupling split-off group $Y_5$ is of the type that will split off preferably at an oxygen atom or a nitrogen atom, and particularly preferably it is of the nitrogen atom split-off type.

The couplers represented by formulae (C-I) to (Y) are contained in the silver halide emulsion layer constituting the photographic layer generally ia an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent for the coupler of the present invention and other couplers, a high-boiling organic solvent represented by the following formula (A), (B), (C), (D), or (E) is preferably used.

Formula (A)

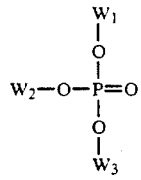

Formula (B)

Formula (C)

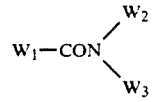

Formula (D)

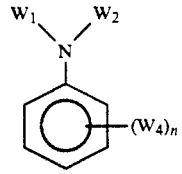

Formula (E)

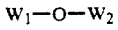

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or S-$W_1$, n is an integer of 1 to 5, when n is 2 or over, $W_4$ groups may be the same or different, and in formula (E), $W_1$ and $W_2$ may together form a condensed ring.

Among these, compounds represented by formulae (A), (B), and (C) are preferable for the purpose of the present invention.

Now, compounds represented by formulae (A) to (C) are described in more details.

In formula (A), (B), or (C), when $W_1$ $W_2$, or $W_3$ has a further substituent, the substituent may be one having a connecting group selected from one or more of

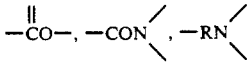

(wherein R represents a phenyl group having 2- to 6-valency that is removed hydrogen atom), and —O—.

Alkyl group represented by $W_1$, $W_2$, or $W_3$ in formulae (A), (B), and (C) may be either straight chain-type or branched type, for example, methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, or eicodecyl group.

As substituents allowable for these alkyl groups, can be mentioned, taking the case of formula (A) as an example, a halogen atom, a cycloalkyl group, an aryl group, and an ester group can be mentioned. The alkyl group includes those substituted by halogen such as F, Cl, and Br (e.g., $-C_2HF_4$, $-C_5H_3F_8$, $-C_6H_3F_{10}$, $-C_2H_4Cl$, $-C_3H_5Cl$, $-C_3H_5Cl_2$, $-C_3H_5ClBr$, and $-C_3H_5Br_2$) cycloalkyl group (e.g.,

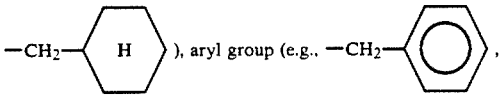

-continued

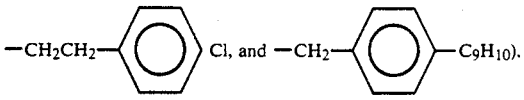

by an ester of dibasic acid (e.g., $CH_2COOCH_2$— 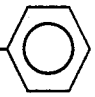 , $CH_2CH_2COOC_{12}H_{25}$, $-(CH_2)_7COOCH_2(CF_2CF_2)_2H$, $-(CH_2)_7COOC_4H_9$, and $-(CH_2)_8COOC_4H_9$, an ester of lactic acid (e.g., $-CH(CH_3)-OCO-$ 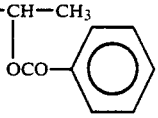 , $-CH(CH_3)-OCO-$ 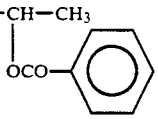 , and $-CH(CH_3)-OH$), an ester of citric acid (e.g., $-CH_2-C(COOCH_3)(COOC_4H_9)-CH_2COOC_4H_9$, and $-CH_2-C(COOCH_3)(COO-CH_2CH(C_2H_5)C_4H_9)-CH_2COOCH_2CH(C_2H_5)C_4H_9$).

an ester of malic acid (e.g., $-CH_2CH(OH)-COOC_6H_{13}$), and an ester of tartalic acid (e.g., $-CH(OH)CH(OH)COOC_8H_{17}$, $-CH(OCOCH_3)CH(OCOCH_3)COOC_4H_9$, and $-CH_2C(OH)(COOC_8H_{17})CH_2COOC_8H_{17}$).

In formula (B) and (C), the same substituent as in alkyl group of formula (A) may be substituted.

Cycloalkyl group represented by $W_1$, $W_2$, or $W_3$ includes, for example,

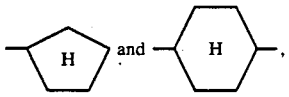

and substituted cyclohexyl group includes, for example,

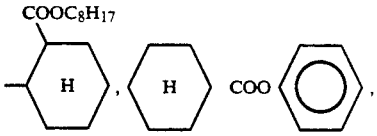

-continued

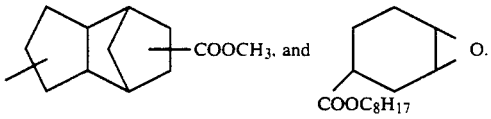

Aryl group represented by $W_1$, $W_2$, or $W_3$ includes, for example,

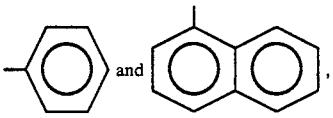

and substituted aryl group includes, for example,

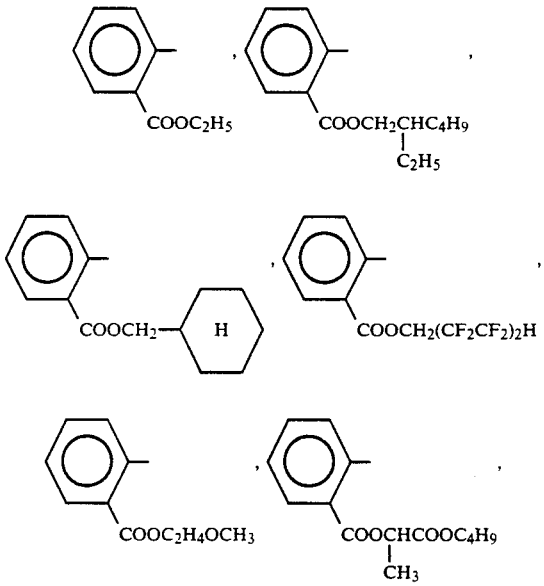

Alkenyl group includes, for example, $-C_4H_7$, $-C_5H_9$, $-C_6H_{11}$, $-C_7H_{13}$, $-C_8H_{15}$, $-C_{10}H_{19}$, $-C_{12}H_{23}$, and $-C_{18}H_{35}$, and substituted alkenyl group includes, for example, substitution product of halogen atom (e.g., F, Cl, and Br), $-OC_8H_{17}$, $-OC_{12}H_{25}$,

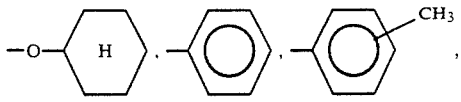

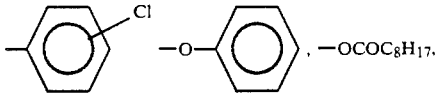

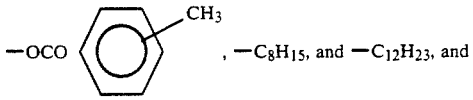

$-CH=CH-COO-CH_2\underset{}{\overset{C_2H_5}{\overset{|}{C}}}HC_4H_9$, and

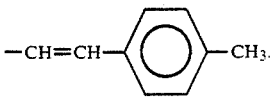

The dielectric constant of these high-boiling solvents of the present invention is more preferably in a range of 3.80 to 5.50.

Specific examples of high-boiling solvent represented by formula (A), (B), or (C) are shown below, but the present invention is not limited to them.

$O=P(OC_4H_9\text{-}n)_3$ (P-1)

$O=P(OCH_2CH_2CH(CH_3)_2)_3$ (P-2)

$O=P(OC_6H_{13}\text{-}n)_3$ (P-3)

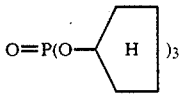

(P-4)

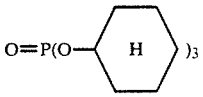

(P-5)

$O=P(OC_8H_{17}\text{-}n)_3$ (P-6)

$O=P(OCH_2CH(C_2H_5)C_4H_9\text{-}n)$ (P-7)

$O=P(OCH_2C(CH_3)_2CH_2CH(CH_3)_2)_3$ (P-8)

$O=P(O(CH_2)_6CH(CH_3)_2)_3$ (P-9)

$O=P(OC_9H_{19}\text{-}n)_3$ (P-10)

$O=P(OCH(CH_3)(CH_2)_6CH_3)_3$ (P-11)

-continued

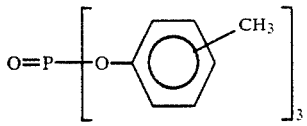

(P-12)

$O=P(OCH_2CH_2CH(CH_3)CH_2CH_2C(CH_3)_3)_3$ (P-13)

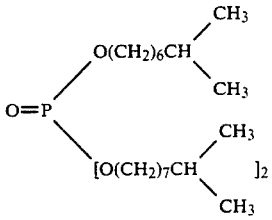

(P-14)

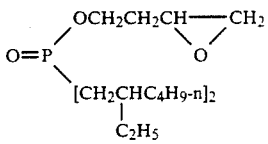

(P-15)

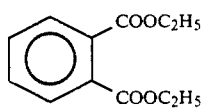

(P-16)

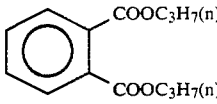

(P-17)

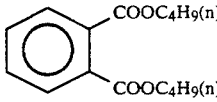

(P-18)

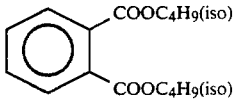

(P-19)

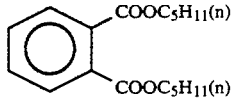

(P-20)

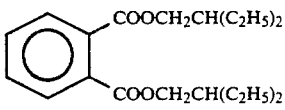

(P-21)

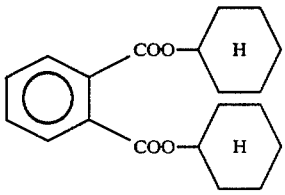

(P-22)

-continued (P-23)

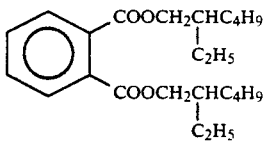

(P-24)

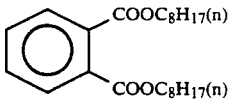

(P-25)

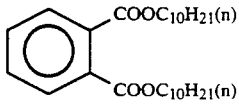

(P-26)

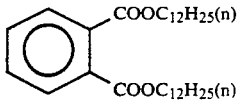

(P-27)

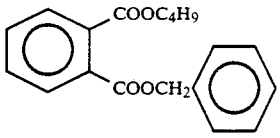

(P-28)

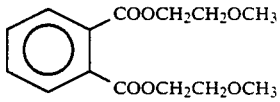

(P-29)

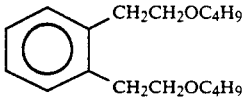

(P-30)

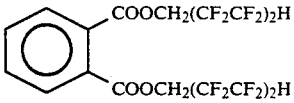

(P-31)

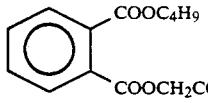

(P-32)

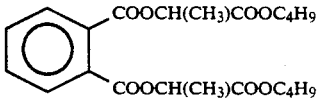

(P-33)

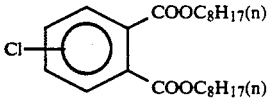

(P-34)

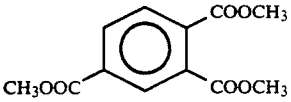

(P-35)

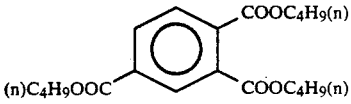

-continued (P-36)

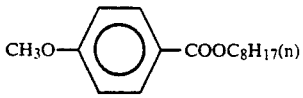

(P-37)

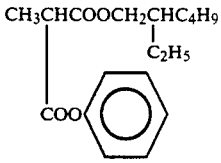

(P-38)

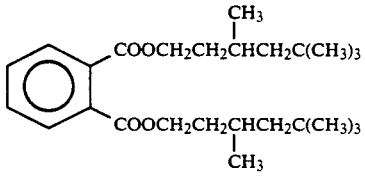

(P-39)

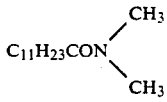

(P-40)

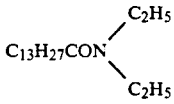

(P-41)

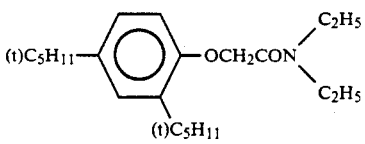

(P-42)

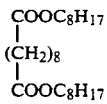

As the high-boiling organic solvent used in the present invention, any compound other than compounds represented by formulae (A ) to (E ) can also be used if the compound has a melting point of 100° C. or below and a boiling point of 140° C. or over, and if the compound is substantially immiscible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

Herein, with respect to the high-boiling organic solvent of the present invention, therm "substantially immiscible with water" means that the solubility to water at 25° C. is 5 weight % or below, and preferably 3 weight % or below.

Although the amount of high-boiling organic solvent to be used in the present invention may be any amount corresponding to the kind and amount of a coupler, preferably the weight ratio of high-boiling organic solvent to the coupler may be 0.05 to 20.

Although presence of at least one emulsion layer containing the high-boiling organic solvent is enough for the color photographic material, preferably it is contained in all emulsion layers. And more preferably the high-boiling solvent is used in layers containing lipophilic material other than emulsion layer.

Further, the high-boiling solvent of the present invention can be used alone or by being mixed. Further, without impairing the effects of the present invention, compounds other than those defined in the present invention can be used in mixture as a high-boiling solvent.

The dielectric constant of the above-mentioned organic solvent is preferably in a range of 3.7 to 6.0.

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic antifading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,932,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt. % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate k2 (in trioctyl phosphate at 80° C.) in the range of 1.0 l/mol·sec to $1\times10^{-5}$ l/mol·sec. The second-order reaction- specific rate can be determined by the method described in JP-A No. 158545/1983.

If k2 is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_{31}-(A)_n-X_{31} \qquad \text{Formula (FI)}$$

-continued $$R_{32}-\underset{\underset{B}{|}}{C}=Y_{32} \qquad \text{Formula (FII)}$$

wherein $R_{31}$ and $R_{32}$ each represent an aliphatic group, an aromatic group, or a heterocyclic group, n is 1 or 0, A represents a group that will react with an aromatic amine developing agent to form a chemical bond therewith, $X_{31}$ represents a group that will react with the aromatic amine developing agent and split off, B represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_{31}$ and $X_{31}$, or $Y_{32}$ and $R_{32}$ or B, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R_{33}-Z_{33} \qquad \text{Formula (GI)}$$

wherein $R_{33}$ represents an aliphatic group, an aromatic group, or a heterocyclic group, $Z_{33}$ represents a nucleophilic group or a group that will decompose in the photographic material to release a nucleophilic group. Preferably the compounds represented by formula (GI) are ones wherein Z represents a group whose Pearson's nucleophilic $^{n}CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987, 229145/1987, 230039/1989, and 57259/1989,and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. The use of a reflection-type base is more preferable.

The "reflection base" is one that enhances reflectivity, thereby making sharper the dye image formed in the silver halide emulsion layer, and it includes one having a base coated with a hydrophobic resin containing a dispersed light- reflective substance, such as titanium oxide, zinc oxide, calcium carbonate, and calcium sulfate, and also a base made of a hydrophobic resin containing a dispersed light- reflective substance. For example, there can be mentioned baryta paper, polyethylene-coated paper, polypropylene- type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 $\mu m \times 6$ $\mu m$, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(R_i-R)^2}{n-1}} \Big/ \frac{\sum_{i=1}^{n}R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

Next, the present invention will be described in detail in accordance with examples, but the invention is not limited to these examples.

EXAMPLE 1

A multilayer color photographic paper was prepared by coating layers as hereinbelow described on a paper laminated on both sides with polyethylene. Coating solutions were prepared as follows:

Preparation of the first-layer coating solution

To a mixture of 60.0 g of yellow coupler (ExY) and 28.0 g of discoloration inhibitor (Cpd-1), 150 ml of ethyl acetate, 1.0 ml of solvent (Solv-3) and 3.0 ml of solvent (Solv-4) were added and dissolved. The resulting solution was added to 450 ml of 10% aqueous gelatin solution, and then the mixture was dispersed by a supersonic homogenizer. The resulting dispersion was mixed with and dissolved in 420 g of silver chloro-bromide emulsion (silver bromide: 0.7 mol %) containing a blue-sensitive sensitizing dye, described below, to prepare the first-layer coasting solution.

Coating solutions for the second to seventh layers were also prepared in the same manner as in the first layer coating solution. As a gelatin hardener for the respective layers, 1,2-bis(vinylsulfonyl)ethane was used.

As spectral sensitizers for the respective layers, the following compounds were used:

Blue-sensitive emulsion layer:

Anhydro-5,5'-dichloro-3,3'-disulfoethylthia-cyanine hydroxide

Green-sensitive emulsion layer:

Anhydro-9-ethyl-5,5'-diphenyl-3,3'-disulfoethyloxacarbocyanine hydroxide

Red-sensitive emulsion layer:

3,3'-Diethyl-5-methoxy-9,9'-(2,2'-dimethyl-1,3-propano)thiacarbocyanine iodide

As a stabilizer for the respective emulsion layer, a mixture (7:2:1 in molar ratio) of the following compounds was used:

1-(2-Acetoaminophenyl)-5-mercaptotetrazole,
1-Phenyl-5-mercaptotetrazole, and
1-(p-Methoxyphenyl)-5-mercaptotetrazole As irradiation preventing dyes the following compounds were used:

[3-Carboxy-5-hydroxy-4-(3-(3-carboxy-5-oxo-1-(2,5-sulfonatophenyl)-2-pyrazoline-4-iridene)-1-propenyl)-1-pyrazolyl]benzene-2,5-disulfonate-disodium salt, N,N'-(4,8-Dihydroxy-9,10-dioxo-3,7-disulfonatoanthracene-1,5-diyl)bis(aminomethanesulfonate)tetrasodium salt, and

[3-Cyano-5-hydroxy-4-(3-(3-cyano-5-oxo-1-(4-sulfonatophenyl)-2-pyrazoline-4-iridene)-1-pentanyl)-1-pyrazolyl]benzene-4-sulfonato-sodium salt

Composition of layers

The composition of each layer is shown below. The figures represent coating amounts (g/m$^2$). The coating amounts of each silver halide emulsion is represented in terms of silver.

Base

Paper support laminated on both sides with polyethylene film and subjected to surface corona discharge treatment

| | |
|---|---|
| First Layer (Blue-sensitive emulsion layer): | |
| The above-described silver chlorobromide emulsion (AgBr: 0.7 mol %, cubic grain, average grain size: 0.9 μm) | 0.25 |
| Gelatin | 1.80 |
| Yellow coupler (ExY) | 0.60 |
| Discoloration inhibitor (Cpd-1) | 0.28 |
| Solvent (Solv-3) | 0.01 |
| Solvent (Solv-4) | 0.03 |
| Second Layer (Color-mix preventing layer): | |
| Gelatin | 0.80 |
| Color-mix inhibitor (Cpd-2) | 0.055 |
| Solvent (Solv-1) | 0.03 |
| Solvent (Solv-2) | 0.15 |
| Third Layer (Green-sensitive emulsion layer): | |
| The above-described silver chlorobromide emulsion (AgBr: 0.7 mol %, cubic grain, average grain size: 0.45 μm) | 0.26 |
| Gelatin | 1.86 |
| Magenta coupler (ExM) | 0.27 |
| Discoloration inhibitor (Cpd-3) | 0.17 |
| Discoloration inhibitor (Cpd-4) | 0.10 |
| Solvent (Solv-1) | 0.20 |
| Solvent (Solv-2) | 0.03 |
| Fourth Layer (Color-mix preventing layer): | |
| Gelatin | 1.70 |
| Color-mix inhibitor (Cpd-2) | 0.065 |
| Ultraviolet absorber (UV-1) | 0.45 |
| Ultraviolet absorber (UV-2) | 0.23 |
| Solvent (Solv-1) | 0.05 |
| Solvent (Solv-2) | 0.05 |
| Fifth Layer (Red-sensitive emulsion layer): | |
| The above-described silver chlorobromide emulsion (AgBr: 4 mol %, cubic grain, average grain size: 0.5 μm) | 0.21 |
| Gelatin | 1.80 |
| Cyan coupler (ExC-1) | 0.26 |
| Cyan coupler (ExC-2) | 0.12 |
| Discoloration inhibitor (Cpd-1) | 0.20 |
| Solvent (Solv-1) | 0.16 |
| Solvent (Solv-2) | 0.09 |
| Color-forming accelerator (Cpd-5) | 0.15 |
| Sixth layer (Ultraviolet ray absorbing layer): | |
| Gelatin | 0.70 |
| Ultraviolet absorber (UV-1) | 0.26 |
| Ultraviolet absorber (UV-2) | 0.07 |
| Solvent (Solv-1) | 0.30 |
| Solvent (Solv-2) | 0.09 |
| Seventh layer (Protective layer): | 1.07 |
| Gelatin | |

Compound used are as follows:

(ExY) Yellow coupler

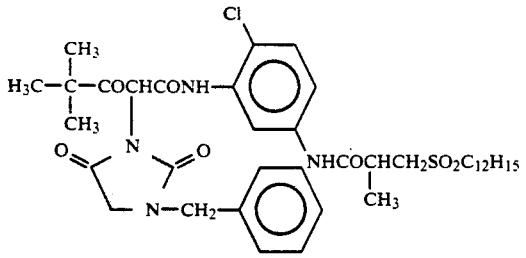

(ExM)

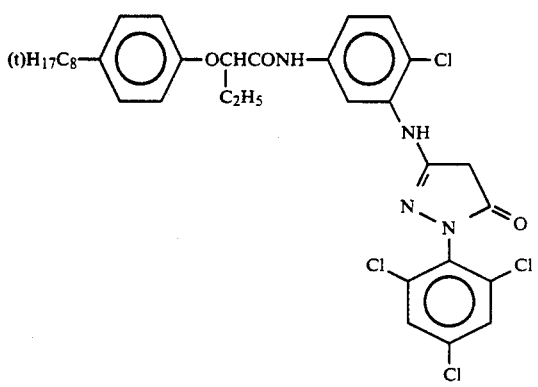

(ExC-1)

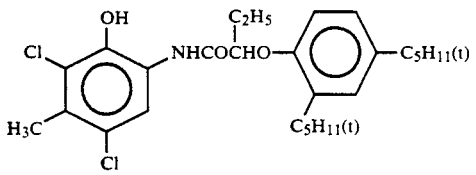

(ExCF2)

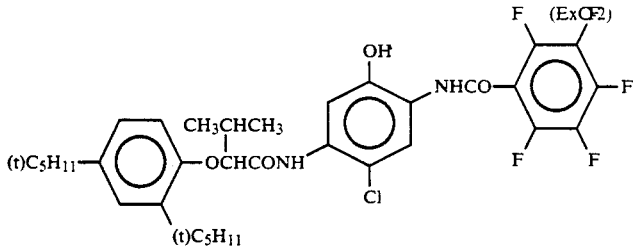

(Cpd-1) Discoloration inhibitor

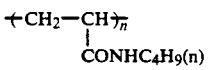

Average molecular weight: 80,000

(Cpd-2) Color-mix inhibitor 2,5-Di-tert-octylhydroquinone (Cpd-3) Discoloration inhibitor 7,7'-dihydroxy-4,4,4',4'-tetramethyl-2,2'-spirocumarone (Cpd-4) Discoloration inhibitor N-(4-dodecyloxyphenyl)-morpholine (Cpd-5) Color-forming accelerator p-(p-Toluenesulfonamido)phenyl-dodecane (Solv-1) Solvent Di(2-ethylhexyl)phthalate (Solv-2) Solvent Dibutylphthalate (Solv-3) Solvent Di(i-nonyl)phthalate (Solv-4) Solvent N,N-diethylcarbonamido-methoxy-2,4-di-t-amylbenzene (UV-1) Ultraviolet absorber 2-(2-Hydroxy-3,5-di-tert-amylphenyl)benzotriazole (UV-2) Ultraviolet absorber 2-(2-Hydroxy-3,5-di-tert-butylphenyl)benzotriazole The thus-prepared coated sample was designated as sample 101. The coated sample 101 was subjected to the test described below using color developer shown below.

First, sample above described was subjected to a gradation exposure to light for sensitometry using a sensitometer (FWH model by Fuji Photo Film Co., Ltd., the color temperature of light source was 3200K). At that time, the exposure was carried out in such a manner that the exposure was 250 CMS with the exposure time being 0.1 second.

The sample above described was processed by the processing process shown below using processing solutions compositions of which are described below. The composition was changed as shown in Table 1.

| Processing steps | Temperature | Time |
|---|---|---|
| Color developing | 38° C. | 45 sec. |
| Bleach-fixing | 37° C. | 45 sec. |
| Water washing 1 | 30–37° C. | 30 sec. |
| Water washing 2 | 30–37° C. | 30 sec. |
| Water washing 3 | 30–37° C. | 30 sec. |
| Drying | 70–85° C. | 60 sec. |

The compositions of the respective processing solution were as follows:

| | |
|---|---|
| Color developer | |
| Water | 800 ml |
| Aditive (see Table 1) | 0.15 g |
| Ethylenediaminetetraphosphonic acid | 9.4 g |
| 1-Hydroxyethylidene-1,1-dephosphonic acid | 0.6 g |
| Triethanolamine | 15.0 g |
| Sodium chloride | 3.0 g |
| Potassium bromide | 0.02 g |
| Potassium carbonate | 25 g |
| N-ethyl-N-(β-methanesulfonamidoethyl)-3-methyl-4-aminoaniline sulfate | 5.0 g |
| Organic preservative (see Table 1) | 0.05 mol |
| Sodium sulfite | see Table 1 |
| Fluorescent brightening agent (WHITEX-4, made by Sumitomo Chem. Ind.) | 1.0 g |
| Water to make | 1000 ml |
| pH (25° C.) | 10.0 |
| Bleach-fixing solution | |
| Water | 400 ml |
| Ammonium thiosulfate (70%) | 100 ml |
| Sodium sulfite | 38 g |
| Iron (III) ammonium ethylenediaminetetraacetate | 55 g |

-continued

| | |
|---|---|
| Disodium ethylenediaminetetraacetate | 5 g |
| Ammonium bromide | 40 g |
| Glacial acetic acid | 9 g |
| Water to make | 1000 ml |
| pH (25° C.) | 5.40 |
| Rinsing solution | |
| (both tank solution and replenisher) Ion-exchanged water (calcium and magnesium each were contained in a concentration of 3 ppm or below) | |

Said color developer was aged for 20 days at a constant temperature of 40° C. with an open area of 25 $cm^2$ per liter in contact with air.

At the start of the above aging, said sensitometry was processed, and the maximum density of cyan color formation was measured by a Macbeth densitometer to assess the color-forming property of the color developer.

Then after the completion of the aging, said sensitometry was processed and the minimum density of the yellow was measured, and then to remove the tarry stain of the coated sample, the sample was dipped in a 5% aqueous acetic acid solution for 5 min and the yellow minimum density was again measured. Thus, the yellow minimum density difference before and after the acid washing of the coated sample was measured to assess the degree of staining of the white background of the coated sample.

Further, it was observed visually whether the color developer after the aging was colored or formed a tarry contaminant.

The results are summarized in Table 1.

TABLE 1

| Experiment No. | Organic Preservative | Concentration of Sodium Sulfite(mol/l) | Additive | Cyan Dmax | Yellow ΔDmax | Coloring of Liquid | Tarry Contaminent | Remarks |
|---|---|---|---|---|---|---|---|---|
| 1 | Hydroxylamine | 0.0 | III-10 | 2.69 | +0.04 | X | X | Comparative Example |
| 2 | Hydroxyacetone | " | " | 2.78 | +0.05 | XX | XX | " |
| 3 | " | " | — | 2.77 | +0.05 | XX | XX | " |
| 4 | " | $1 \times 10^{-2}$ | III-10 | 2.19 | +0.02 | ○ | ○ | " |
| 5 | " | " | — | 2.21 | +0.02 | ○~Δ | Δ | " |
| 6 | I-1 | " | III-10 | 2.22 | +0.01 | ○ | ○ | " |
| 7 | II-19 | " | | 2.30 | +0.01 | ○ | ○ | " |
| 8 | I-1 | 0.0 | — | 2.79 | +0.04 | X | XX | " |
| 9 | II-19 | " | — | 2.80 | +0.04 | XX | XX | " |
| 10 | I-1 | " | III-10 | 2.78 | +0.01 | ○ | ○ | This Invention |
| 11 | " | " | III-1 | 2.78 | +0.01 | ○~Δ | ○~Δ | " |
| 12 | " | " | III-3 | 2.77 | +0.01 | ○~Δ | Δ | " |
| 13 | " | " | III-17 | 2.79 | +0.01 | ○ | ○ | " |
| 14 | " | " | III-20 | 2.77 | ±0.00 | ○ | ○ | " |
| 15 | " | " | III-9 | 2.78 | ±0.01 | ○~Δ | ○ | " |
| 16 | " | $1 \times 10^{-5}$ | " | 2.78 | ±0.00 | ○ | ○ | " |
| 17 | I-12 | 0.0 | " | 2.80 | ±0.01 | ○ | ○ | " |
| 18 | I-17 | " | " | 2.81 | ±0.00 | ○ | ○ | " |
| 19 | I-23 | " | " | 2.78 | +0.01 | ○~Δ | ○ | " |
| 20 | I-48 | " | " | 2.79 | +0.01 | ○~Δ | ○ | " |
| 21 | I-52 | " | " | 2.79 | ±0.00 | ○ | ○ | " |
| 22 | II-19 | " | " | 2.78 | ±0.00 | ○ | ○ | " |
| 23 | II-19 | " | III-10 | 2.80 | +0.01 | ○ | ○ | " |

Notes:

(a) Criteria of coloring of liquid
- ○: nearly same as fresh
- Δ: light brown
- X: dark brown
- XX: black (b) Criteria of tarry contaminant
- ○: almost none
- Δ: present a little amount
- X: present considerably large amount
- XX: present large amount (c) Compounds employed TABLE 1-continued

| Experiment No. | Organic Preservative | Concentration of Sodium Sulfite(mol/l) | Additive | Cyan Dmax | Yellow ΔDmax | Coloring of Liquid | Tarry Contaminent | Remarks |
|---|---|---|---|---|---|---|---|---|
| III-1 | 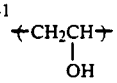 | | | | | | | |
| III-3 | 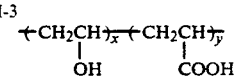 x:y = 9:1 (in weight ratio) | | | | | | | |
| III-9 | 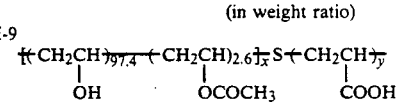 x:y = 9:1 (in weight ratio) | | | | | | | |
| III-10 | 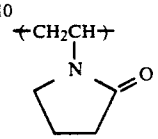 | | | | | | | |
| III-17 | 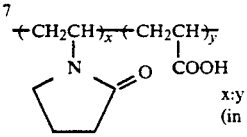 x:y = 9:1 (in weight ratio) | | | | | | | |
| III-20 | 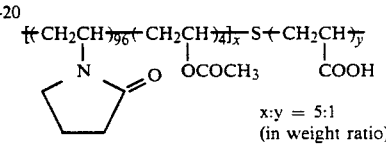 x:y = 5:1 (in weight ratio) | | | | | | | |

As is apparent from Table 1, when the constitutional requirements of the present invention are satisfied, a color image high in maximum density and excellent in whiteness is obtained with the contamination of the color developer after aging being less, thereby attaining the objects of the present invention (Experiment Nos. 10 to 23).

If the compounds of formulae (I) and (II) of the present invention and a sulfite are not contained, irrespective of the presence or absence of the polymer of the present invention, an increase in yellow minimum density (ΔDmin) is great and the coloration and the formation of a tarry contaminant of the color developer are great, which is far from attaining the objects of the present invention (Experiment Nos. 1 to 3).

When the polymer of the present invention is not contained and a sulfite is not also contained, irrespective of the presence or absence of the compounds of formulae (I) and (II), the increase in yellow minimum density (ΔDmin) is great and the coloration and the formation of a tarry contaminant of the color developer are great, which is far from attaining the objects of the present invention (Experiment Nos. 3, 5, 8, and 9).

When a sulfite is contained in the color developer, irrespective of the presence or absence of the compounds of formulae (I) and (II) and the polymer of the present invention, the increase in yellow minimum density and the coloration and the formation of a tarry contaminant are little but the maximum density is low, which is far from attaining the objects of the present invention.

Experiments 4 to 7

Thus, when the constitutional requirements of the present invention are simultaneously satisfied, the effect of the present invention is exhibited, so that the uniqueness of the combination of the constitutional requirements of the present invention can be understood.

Although the density difference in the yellow minimum density increase between Experiment Nos. 1 and 10 is 0.03, which is very little, when their white backgrounds are compared visually, their whiteness is clearly different. An increase of 0.03 or more in minimum density is of practical significance, and an increase of 0.05 or more falls in such a range that it loses its commercial value.

EXAMPLE 2

A multilayer photographic material was prepared by multi-coatings composed of the following layer composition on a two-side polyethylene laminated paper support. Coating solutions were prepared as follows:

Preparation of the first layer coating solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a silver chlorobromide emulsion (cubic grains, having 0.82 μm of average grain size, and 0.08 of deviation coefficient of grain size distribution, in which 0.2 mol % of silver bromide was located at the surface of grains) in such amounts that each dye corresponds $2.0\times10^{-4}$ mol per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

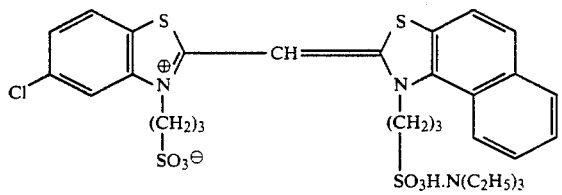

and

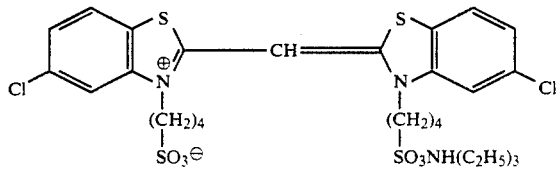

(each $2.0\times10^{-4}$ mol per mol of silver halide.)

Green-sensitive emulsion layer:

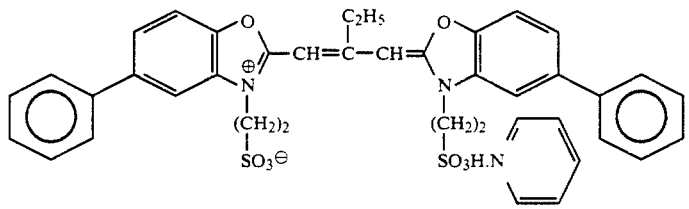

($5.6\times10^{-4}$ mol per mol of silver halide)

and

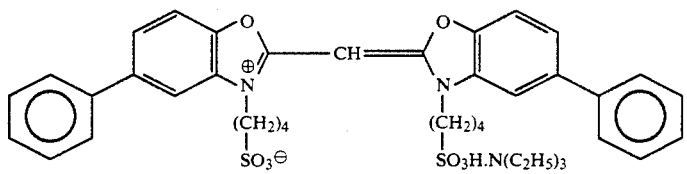

($1.0\times10^{-5}$ mol per mol of silver halide)

Red-sensitive emulsion layer:

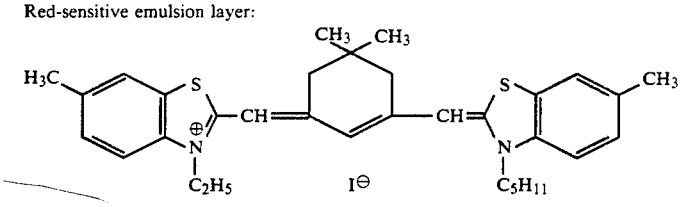

($0.9\times10^{-4}$ mol to the large size emulsion and
$1.1\times10^{-4}$ mol to the small size emulsion, per mol of silver halide)

To the red-sensitive emulsion layer, the following compound was added in an amount of $2.6\times10^{-3}$ mol per mol of silver halide:

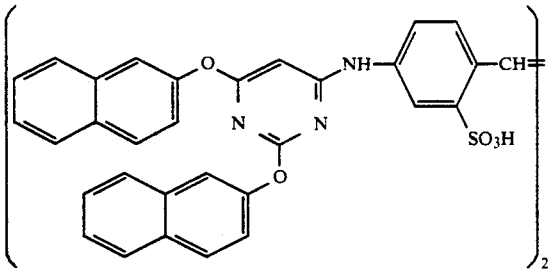

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.7\times10^{-4}$ mol, and $2.5\times10^{-4}$ mol, per mol of silver halide, respectively.

Further, 4-hydroxyl-6-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below were added to the emulsion layers for prevention of irradiation.

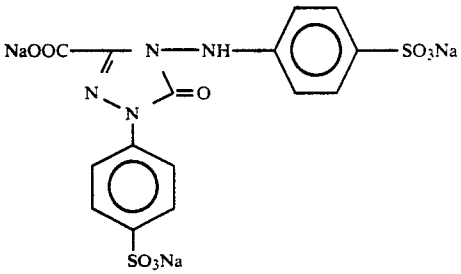

(7.1 g/m$^2$ of photographic material)

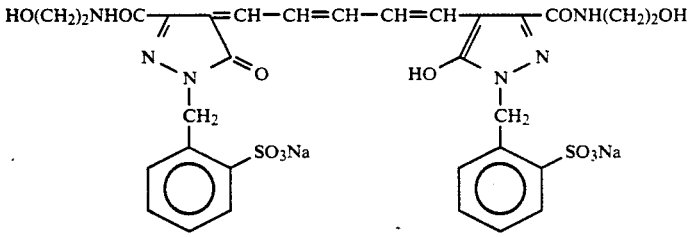

(14.7 g/m$^2$ of photographic material)

and

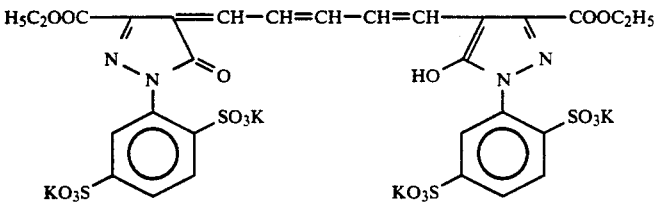

(36.2 g/m$^2$ of photographic material)

Composition of Layers

The composition of each layer is shown below. The figures represent coating amount (g/m$^2$). The coating amount of each silver halide emulsion is given in terms of silver.

Supporting Base

Paper laminated on both sides with polyethylene (a white pigment, $TiO_2$, and a bluish dye, ultra-marine, were included in the first layer side of the polyethylene-laminated film)

| | |
|---|---|
| First Layer (Blue-sensitive emulsion layer): | |
| The above-described silver chlorobromide emulsion | 0.25 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains having 0.40 μm of average grain size, and 0.08 of deviation coefficient of grain size distribution, in which 0.8 mol % of AgBr was located at the surface of grains) | 0.12 |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |

-continued

| | |
|---|---|
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet ray absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains having 0.60 μm of average grain size, and 0.09 of deviation coefficient of grain size distribution, in which 0.6 mol % of AgBr was located at the surface of grains) | 0.20 |
| Gelatin | 1.34 |
| Cyan coupler (ExC) | 0.32 |

-continued

| | |
|---|---|
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of R =

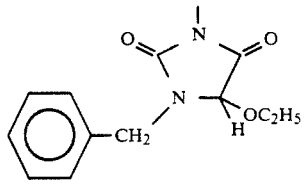

and R =

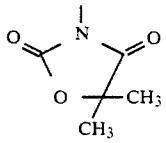

of the following formula

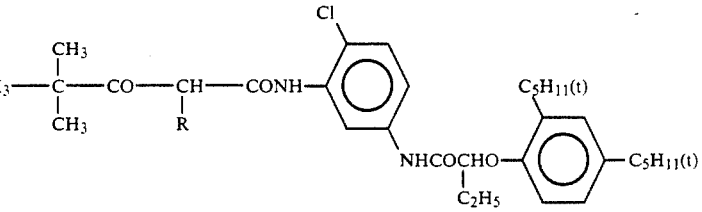

(ExM) Magenta coupler

Mixture (1:1 in molar ratio) of

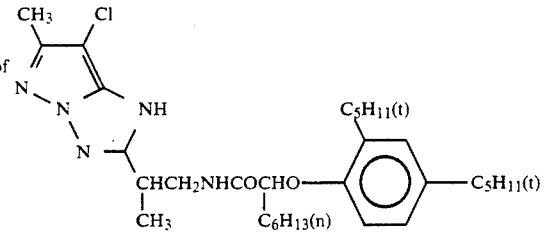

and

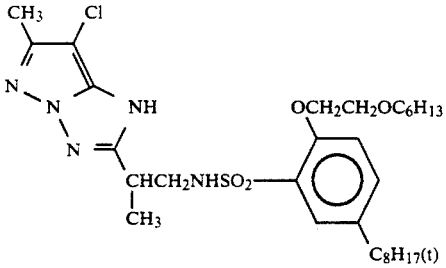

(ExC) Cyan coupler

Mixture (2:4:4 in weight ratio) of

R = $C_2H_5$ and $C_4H_9$ of

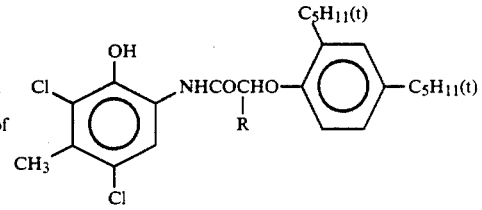

and

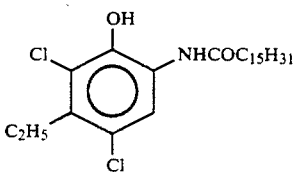

-continued
(Cpd-1) Image-dye stabilizer
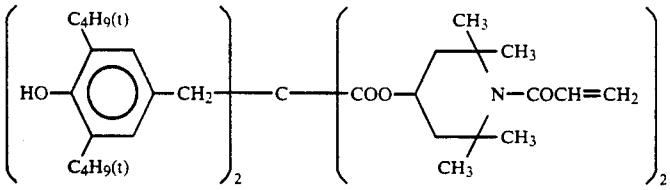
(Cpd-2) Image-dye stabilizer
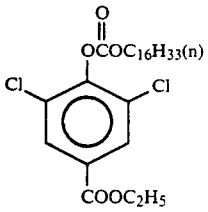
(Cpd-3) Image-dye stabilizer
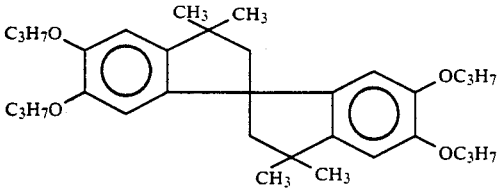
(Cpd-4) Image-dye stabilizer
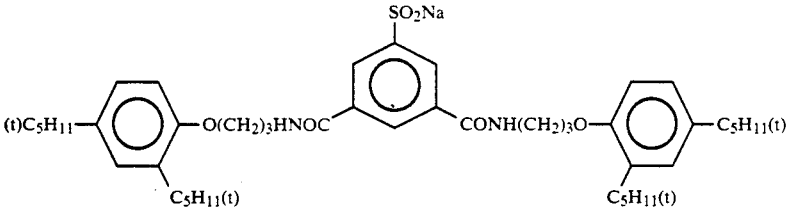
(Cpd-5) Color-mix inhibitor
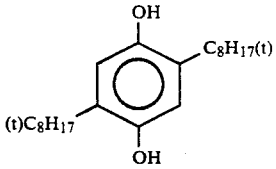
(Cpd-6) Image-dye stabilizer
Mixture (2:4:4 in weight ratio) of
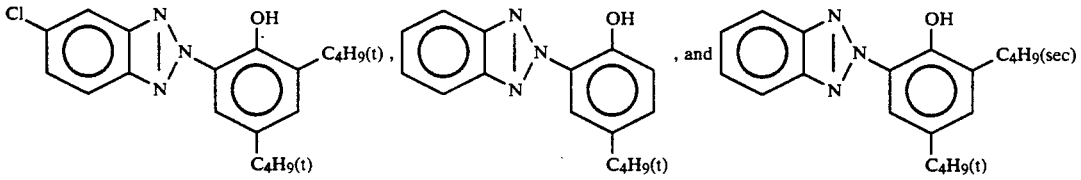
(Cpd-7) Image-dye stabilizer
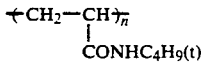
Average molecular weight: 60,000
(Cpd-8) Image-dye stabilizer -continued
Mixture (1:1 in weight ratio) of 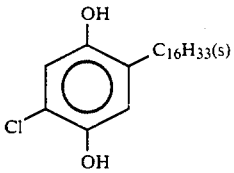 and 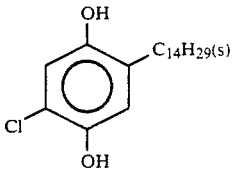
(Cpd-9) Image-dye stabilizer
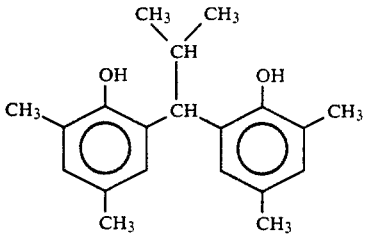
(UV-1) Ultraviolet ray absorber
Mixture (4:2:4 in weight ratio) of 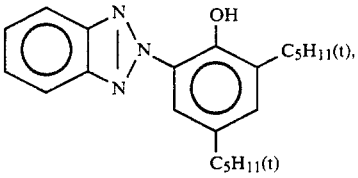
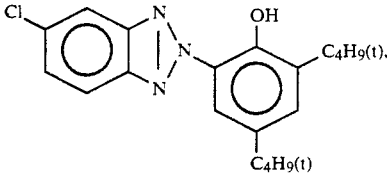 and 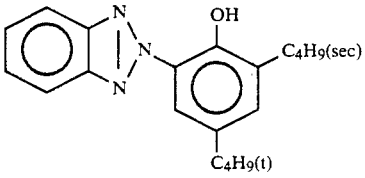
(Solv-1) Solvent
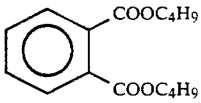
(Solv-2) Solvent
Mixture (2:1 in volume ratio) of 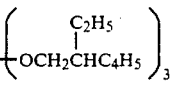 and 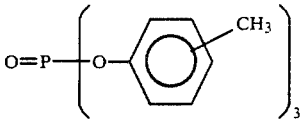
(Solv-4) Solvent
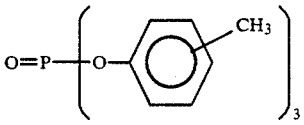
(Solv-5) Solvent
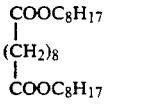
(Solv-6) Solvent -continued Mixture (95:5 in volume ratio) of 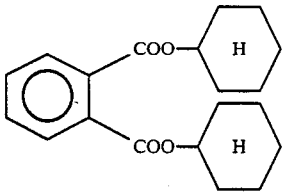 and $C_8H_{17}CHCH(CH_2)_7COOC_8H_{17}$ (O)

The thus-prepared sample was designated as 201.

The sample was subjected to a continuous processing (running test) through the following steps shown below by using an automatic paper-processor, until a volume of color developer twice that of a tank had been replenished.

The composition of the color developer was changed as shown in Table 2.

| Processing step | Temperature | Time | Replenisher Amount* | Tank Volume |
|---|---|---|---|---|
| Color developing | 39° C. | 45 sec. | 30 ml | 4 l |
| Bleach-fixing | 30–35° C. | 45 sec. | 215 ml | 4 l |
| Stabilizing 1 | 30–37° C. | 20 sec. | — | 2 l |
| Stabilizing 2 | 30–37° C. | 20 sec. | — | 2 l |
| Stabilizing 3 | 30–37° C. | 20 sec. | 364 ml | 2 l |
| Drying | 70–85° C. | 60 sec. | | |

Note:
*Replenisher amount is shown in ml per $m^2$ of photographic material. Stabilizing steps were carried out in 3-tanks counter-flow mode from the tank of stabilizing 3 towards the tank of stabilizing 1. The opened surface ratio was changed by changing the size of floating lid.

The compositions of each processing solution were as follows:

| | Tank Solution | Replenisher |
|---|---|---|
| Color developer | | |
| Water | 800 ml | 800 ml |
| Additive (see Table 2) | 0.2 g | 0.2 g |
| Ethylenediamine-tetraphosphonic acid | 14.1 g | 14.1 g |
| Diethylenetriamineheptraacetate | 1.8 g | 1.8 g |
| 1-Hydroxyethylidene-1,1-diphosphonic acid | 0.9 g | 0.9 g |
| Triethanolamine | 15.0 g | 15.0 g |
| Sodium chloride | 8.0 g | — |
| Potassium bromide | 0.03 g | — |
| Potassium carbonate | 25 g | 25 g |
| N-ethyl-N-(β-methanesulfonamidoethyl)-3-methyl-4-aminoaniline sulfonate | 5.0 g | 9.5 g |
| Organic preservative (see Table 2) | 0.05 mol | 0.08 mol |
| Sodium sulfite | 0.1 g | 0.2 g |
| Fluorescent brightening agent (diaminostilbene series, WHITEX-4, made by Sumitomo Chemical Ind. Co.) | 1.0 g | 6.0 g |
| Water to make | 1000 ml | 1000 ml |
| pH (25° C.) | 10.00 | 11.25 |
| Bleach-fixing solution (Both tank solution and replenisher) | | |
| Water | 400 ml | |
| Ammonium thiosulfate (70%) | 100 ml | |
| Sodium sulfite | 17 g | |
| Iron (III) ammonium ethylenediamine-tetraacetate dihydrate | 55 g | |
| Disodium ethylenediaminetetraacetate | 5 g | |
| Glacial acetic acid | 9 g | |
| Water to make | 1000 ml | |
| pH (25° C.) | 5.40 | |
| Stabilizing solution (Both tank solution and replenisher) | | |
| Formalion (37%) | 0.1 g | |
| Formalin-sulfurus acid adduct | 0.7 g | |
| 5-Chloro-2-methyl-4-thiazolin-3-one | 0.02 g | |
| 2-Methyl-4-isothiazoline-3-one | 0.01 g | |
| Copper sulfate | 0.005 g | |
| Aqueous ammonia | 2.0 g | |
| Water to make | 1000 ml | |
| pH (25° C.) | 4.0 | |

The above coated samples were given gradation exposure for sensitometry by using a sensitometer (FWH model, manufactured by Fuji Photo Film Co., Ltd.; the color temperature of the light source: 3200K). The exposure to light was performed in such a manner that the exposure time was 1/10 sec and the exposure amount was 250 CMS.

After the completion of the running test, said sensitometry was processed, then after the yellow minimum density was measured in the same manner as in Example 1, the sample was acid-washed and the yellow minimum density difference before and after the acid washing of the sample was measured to assess the degree of staining of the whiteness of the coated sample.

Clogging of the filter attached to the inlet of the color developer replenishing pump and the state of adhesion of a tarry contaminant to the processing tank near the solution surface were observed visually.

The results are summarized in Table 2.

TABLE 2

| Experiment No. | Preservative | Additive | Yellow ΔDmin | Clogging of Filter | Tarry Contaminant | Remarks |
|---|---|---|---|---|---|---|
| 1 | Hydroxylamine | III-10 | +0.04 | Δ | Δ | Comparative Example |
| 2 | Hydroxylacetone | III-10 | +0.04 | Δ | X | " |
| 3 | Phenyl semicarbazide | III-10 | +0.06 | X | X | " |
| 4 | Hydroxylamine | — | +0.05 | X | X | " |
| 5 | Hydroxylacetone | — | +0.04 | X | Δ | " |
| 6 | Phenyl semicarbazide | — | +0.06 | X | X | " |
| 7 | I-1 | — | +0.04 | Δ | X | " |
| 8 | II-19 | — | +0.05 | X | X | " |
| 9 | I-1 | III-10 | +0.01 | ○ | ○ | This Invention |
| 10 | II-19 | III-10 | +0.01 | ○ | ○ | " |
| 11 | II-19 | III-1 | +0.01 | ○ | ○ | " |
| 12 | II-19 | III-3 | +0.02 | ○ | ○ | " |

TABLE 2-continued

| Experiment No. | Preservative | Additive | Yellow ΔDmin | Clogging of Filter | Tarry Contaminant | Remarks |
|---|---|---|---|---|---|---|
| 13 | II-19 | III-17 | +0.01 | ○ | ○ | " |
| 14 | II-19 | III-9 | ±0.00 | ○ | ○ | " |
| 15 | I-12 | III-9 | +0.01 | ○ | ○ | " |
| 16 | I-17 | III-9 | ±0.00 | ○ | ○ | " |
| 17 | I-23 | III-9 | +0.02 | ○ | ○ | " |
| 18 | I-48 | III-9 | +0.01 | ○ | ○ | " |
| 19 | I-52 | III-9 | +0.01 | ○ | ○ | " |

Notes:
(a) Criteria of clogging of tarry contaminant
○: almost none
Δ: present
X: present in large amount
(b) Compounds employed
III-1 The same as in Example 1
III-3 The same as in Example 1
III-9 The same as in Example 1
III-10 The same as in Example 1
III-17 The same as in Example 1

As is apparent from the results in Table 2, when the compounds of formulae (I) and (II) of the present invention were used together with the polymer of the present invention, a color image excellent in whiteness was obtained, and further, good results were obtained in that there was neither clogging of the filter nor tarry stuck matter due to deterioration and contamination of the color developer and the color developer replenisher.

EXAMPLE 3

Coated sample 201 prepared in Example 2 was subjected to the same running test as in Example 2.

Condition of processing, processing step, and the composition of processing solution used are as follows.

| Processing step | Temperature | Time | Replenisher Amount* | Tank Volume |
|---|---|---|---|---|
| Color developing | 38° C. | 45 sec. | 70 ml | 4 l |
| Bleach-fixing | 30–36° C. | 45 sec. | 215 ml | 4 l |
| Stabilizing 1 | 30–37° C. | 20 sec. | — | 2 l |
| Stabilizing 2 | 30–37° C. | 20 sec. | — | 2 l |
| Stabilizing 3 | 30–37° C. | 20 sec. | 364 ml | 2 l |
| Drying | 70–85° C. | 60 sec. | | |

Note:
*Replenisher amount is shown in ml per $m^2$ of photographic material.
Stabilizing steps were carried out in 3-tanks counter-flow mode from the tank of stabilizing 3 towards the tank of stabilizing 1.
The opened surface ratio was changed by changing the size of floating lid.

The compositions of each processing solution were as follows:

| | Tank Solution | Replenisher |
|---|---|---|
| Color developer | | |
| Water | 800 ml | 800 ml |
| Additive (III-9) | 0.2 g | 0.2 g |
| Ethylenediamine-tetraphosphonic acid | 9.4 g | 9.4 g |
| Diethylenetriaminepentaacetate | 1.2 g | 1.2 g |
| 1-Hydroxyethylidene-1,1-diphosphonic acid | 0.6 g | 0.6 g |
| Triethanolamine | 1.0 g | 1.0 g |
| Sodium chloride | 5.0 g | — |
| Potassium bromide | 0.02 g | — |
| Potassium carbonate | 25 g | 25 g |
| N-ethyl-N-(β-methanesulfonamidoethyl)-3-methyl-4-aminoaniline sulfonate | 5.0 g | 11.5 g |
| Organic preservative (I-17) | 0.04 mol | 0.06 mol |
| Sodium sulfite | 0.1 g | 0.2 g |
| Fluorescent brightening agent (diaminostilbene series, WHITEX-4, made by Sumitomo Chemical Ind. Co.) | 1.0 g | 6.0 g |
| Water to make | 1000 ml | 1000 ml |
| pH (25° C.) | 10.00 | 10.80 |
| Bleach-fixing solution (Both tank solution and replenisher) | | |
| Water | 400 ml | |
| Ammonium thiosulfate (70%) | 100 ml | |
| Sodium sulfite | 17 g | |
| Iron (III) ammonium ethylenediaminetetraacetate dihydrate | 55 g | |
| Disodium ethylenediaminetetraacetate | 5 g | |
| Glacial acetic acid | 9 g | |
| Water to make | 1000 ml | |
| pH (25° C.) | 5.40 | |
| Stabilizing solution (Both tank solution and replenisher) | | |
| Formalin (37%) | 0.1 g | |
| Formalin-sulfurus acid adduct | 0.7 g | |
| 5-Chloro-2-methyl-4-thiazolin-3-one | 0.02 g | |
| 2-Methyl-4-isothiazoline-3-one | 0.01 g | |
| Copper sulfate | 0.005 g | |
| Aqueous ammonia | 2.0 g | |
| Water to make | 1000 ml | |
| pH (25° C.) | 4.0 | |

After running test, the same evaluation of whiteness, clogging of filter, and tarry contaminant as in Example 2, and the similar good results were obtained.

EXAMPLE 4

Photographic material samples 401 to 406 were prepared by the same manner as photographic material 201 in Example 2, except that solvents (Solv. 1 to 5) were changed as shown in Table 3. Then they were subjected to development processing as described below.

TABLE 3

| Sample No. | Solv. 1 | Solv. 2 | Solv. 3 | Solv. 4 | Solv. 6 |
|---|---|---|---|---|---|
| 401 | P-18 | P-7 | P-22 | P-12 | P-42 |
| 402 | P-23 | P-3 | P-3 | P-12 | P-41 |
| 403 | P-18 | P-6 | P-41 | P-19 | P-23 |
| 404 | P-31 | P-7 | P-39 | P-12 | P-25 |
| 405* | a | b | b | a | c |

TABLE 3-continued

| Sample No. | Solv. 1 | Solv. 2 | Solv. 3 | Solv. 4 | Solv. 6 |
|---|---|---|---|---|---|
| 406* | a | a | b | c | c |

Note:
*Comparative compound (a)
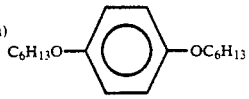

(b)
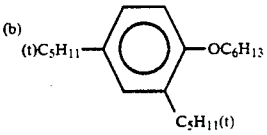

(c)
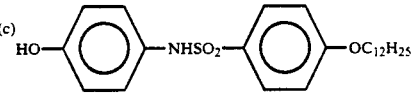

Next, processing solutions shown below were prepared.

| | Tank Solution | Replenisher |
|---|---|---|
| Color developer | | |
| Water | 700 ml | 700 ml |
| Water soluble polymer of the present invention (See Table 4) | 0.5 g | 0.5 g |
| Diethylenetriamine-heptaacetic acid | 0.4 g | 0.4 g |
| N,N,N-tetrakis(methylene-phophonic acid) | 4.0 g | 4.0 g |
| Disodium 1,2-dihydroxybenzene-4,6-diphophonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightening agent (WHITEX 4B, prepared by Sumitomo Chemical Ind.) | 1.0 g | 3.0 g |
| Sodium sulfite | 0.1 g | 0.1 g |
| N,N-Bis(sulfoethyl)hydroxyamine | 10.0 g | 13.0 g |
| N-Ethyl-N-(β-methanesulfonamido-ethyl)-3-methy-4-aminoaniline sulfate | 5.0 g | 11.5 g |
| Water to make | 1,000 ml | 1,000 ml |
| pH (25° C.) | 10.10 | 11.10 |
| Bleach-fixing solution | | |
| Water | 600 ml | 150 ml |
| Ammonium thiosulfate (700 g/l) | 100 ml | 250 ml |
| Ammonium sulfate | 40 g | 100 g |
| Fe(III) ammonium ethylenediamine-tetraacetate | 55 g | 135 g |
| Ethylenediaminetetraacetic acid | 5 g | 12.5 g |
| Ammonoim bromide | 40 g | 75 g |
| Nitric acid (67%) | 30 g | 65 g |
| Water to make | 1,000 ml | 1,000 ml |
| pH (25° C.)(by acetic acid and aqueous ammonia) | 5.8 | 5.6 |
| Rinsing solution (Both tank solution and replenisher) | | |
| Ion-exchanged water (concentrations of calsium and magnesium were both 2 ppm or below) | | |

The thus-prepared color paper sample 401 was exposed to light imagewisely and subjected to a continuous processing of processing process shown below, until the replenishing amount of color developer reached twice volume of tank. Further, samples 401 to 406 were subjected to an exposure to light of 250 CMS through an optical wedge and processed before and after the continuous processing.

| Processing Process | Temperature | Time | Replenisher Amount* | Tank Volume |
|---|---|---|---|---|
| Color developing | 39° C. | 45 sec. | 70 ml | 20 l |
| Bleach-fixing | 35° C. | 45 sec. | 60 ml** | 20 l |
| Rinsing (1) | 35° C. | 20 sec. | — | 10 l |
| Rinsing (2) | 35° C. | 20 sec. | — | 10 l |
| Rinsing (3) | 35° C. | 20 sec. | 360 ml | 10 l |
| Drying | 80° C. | 60 sec. | | |

Note:
*Replenishing amount per $m^2$ of photographic paper Rinsing processes were carried out in 3-tanks counter-current flow mode from the tank of rinsing (3) toward the tank of rinsing (1).
**In addition to the above-shown 60 ml, 120 ml of solution per $m^2$ of photographic paper was flown into from the tank of rinsing (1).

As the change of photographic property before and after continuous processing, ΔDmin that is the change of Dmin was evaluated as the increment of cotamination. Further, the sample evaluated for ΔDmin was washed in 2% acetic acid solution at 30° C. for 2 minutes, and the change of Dmin was evaluated. Results are shown in Table 4.

TABLE 4

| Sample No. | Water-Soluble Polymer | ΔDmin | ΔDmin before and after Acid Washing | Remarks |
|---|---|---|---|---|
| 401 | III-10 | +0.01 | ±0 | This Invention |
| 402 | " | +0.02 | −0.01 | " |
| 403 | " | +0.01 | ±0 | " |
| 404 | " | +0.01 | −0.01 | " |
| 405 | " | +0.04 | −0.03 | " |
| 406 | " | +0.05 | −0.03 | " |
| 401 | III-13 | ±0 | ±0 | This Invention |
| 402 | " | +0.02 | −0.01 | " |
| 403 | " | +0.01 | ±0 | " |
| 404 | " | +0.01 | ±0 | " |
| 405 | " | +0.05 | −0.03 | " |
| 406 | " | +0.05 | −0.03 | " |
| 401 | III-16 | +0.01 | ±0 | This Invention |
| 402 | " | +0.01 | ±0 | " |
| 403 | " | +0.01 | ±0 | " |
| 404 | " | +0.01 | ±0 | " |
| 405 | " | +0.04 | −0.03 | " |
| 406 | " | +0.04 | −0.04 | " |

Note:
III-10: Polyvinylpyrrolidone Polymerization degree: 1,000
III-13: Vinylpyrrolidone/methacrylic acid (9:1 in weight ratio) copolymer Polymerization degree: 1,000
III-16: Vinylpyrrolidone/methacrylamide (9:1 in weight ratio) copolymer Polymerization degree: 1,000

As is apparent from the results in Table 4, it is noticed that, among processing methods of the present invention, to utilize a high-boiling organic solvent represented by formula (A), (B), or (C) in the photographic material is particularly preferable.

EXAMPLE 5

The photographic material sample 201 prepared in Example 2 was exposed to light imagewisely, and then was subjected to a continuous processing of processing process shown below.

| Process | Time (sec.) | Temperature (°C.) | Replenishing Amount (ml/$m^2$) |
|---|---|---|---|
| Color developing | 45 | 38 | 80 |
| Bleaching | 90 | 38 | 200 |
| Water-washing | 45 | 30 | 1,000 |
| Fixing | 60 | 38 | 200 |
| Water-washing | 90 | 30 | 10.000 |

-continued

| Process | Time (sec.) | Temperature (°C.) | Replenishing Amount (ml/m²) |
|---|---|---|---|
| Drying | 60 | 70–90 | |

Compositions of respective processing solutions used are as follows:

| | Tank Solution | Replenisher |
|---|---|---|
| Color developer | | |
| Water | 600 ml | 600 ml |
| 1-Hydroxyethylidene-1,1-diphosphonic acid (60%) | 2.0 g | 2.0 g |
| Triethanolamine | 4.0 g | 4.0 g |
| III-9 | 0.2 g | 0.2 g |
| Litium sulfate | 1.0 g | 1.0 g |
| Diethylhydroxylamine | 3.0 g | 4.0 g |
| Sodium chloride | 3.0 g | — |
| N-Ethyl-N-(β-methanesulfonamidoethyl)-3-methyl-4-aminoaniline sulfate | 4.0 g | 8.5 g |
| Fluorescent brightening agent (UVITEX-CK, made by Ciba-Geigy) | 1.5 g | 3.0 g |
| Potassium carbonate | 27 g | 27 g |
| Water to make | 1,000 ml | 1,000 ml |
| pH (by KOH) | 10.0 | 10.8 |
| Bleaching solution | | |
| Water | 600 ml | 600 ml |
| Fe(III) ammonium ethylenediaminetetraacetate | 30 g | 40 g |
| Ethylenediaminetetraacetic acid | 2 g | 2 g |
| Ammonium bromide | 50 g | 65 g |
| Nitric acid | 5 g | 8 g |
| Water to make | 1,000 ml | 1,000 ml |
| pH | 5.0 | 4.5 |
| Fixing solution | | |
| Water | 600 ml | 600 ml |
| Sodium thiosulfate | 100 g | 110 g |
| Sodium sulfite | 15 g | 20 g |
| Disodium ethylenediaminetetraacetate | 2 g | 3 g |
| Water to make | 1,000 ml | 1,000 ml |
| pH | 7.0 | 7.3 |

Continuous processing was continued until overflowed volumes of bleaching solution and fixing solution reached 10 liters, respectively. Each overflowed solution was regenerated by the method shown below, and was reused as a replenishing solution.

Regeneration of bleaching solution

Chemicals shown below were added to 10 liters of overflowed solution, and the pH of solution was adjusted to 4.5.

| | |
|---|---|
| Fe(III) ammonium ethylenediaminetetraacetate | 100 g |
| Ethylenediaminetetraacetic acid | 10 g |
| Ammonium bromide | 150 g |
| Nitric acid | 30 g |

Regenerated solution obtained was used as a replenishing solution.

Regeneration of fixing solution

Chemicals shown below were added to 10 liters of overflowed solution, and the pH of solution was adjusted to 7.3.

| | |
|---|---|
| Sodium thiosulfate | 100 g |
| Sodium sulfite | 50 g |
| Disodium ethylenediaminetetraacetate | 10 g |

Regenerated solution obtained was used as a replenishing solution.

Continuous processing was continued until the regeneration above-described was repeated 10 times. At that point, the concentration of total iron ions was measured by an atomic absorption spectrometry. The concentration of Fe(II) complex was measured by a coloring method using basophenanthroline. As a result, it was that the ratio of Fe(II) complex was 30%.

According to the processings of the present invention, minimum density and the amount of residual silver were made very low and good color image was obtained when the ratio of Fe (II) was 3 to 30%. Further, in such processing as this, good results can be obtained by using the compound of the present invention.

Sample A was exposed to light through an wedge and processed by using above-described processing solutions. Minimum density of magenta at unexposed part of processed sample was measured by Macbeth densitometer to evaluate bleach-fogging. Further, the amount of residual silver at the maximum exposed part was measured by a flurescent X-ray method.

Next, the concentration of Fe(II) in bleaching solution was reduced by bubbling of air into the tank of bleaching solution and, at the same time, sample A was treated in the same manner as described above. Thus the relation of bleach-fogging and desilvering property to the ratio of (Fe)II complex were determined. Results are shown in Table 5.

TABLE 5

| No. | Fe (II) % | Dmin | Amount of Ag μg/cm² | Remarks |
|---|---|---|---|---|
| 1 | 30 | 0.10 | 11 | This Invention |
| 2 | 25 | 0.10 | 9 | This Invention |
| 3 | 20 | 0.10 | 3 | This Invention |
| 4 | 10 | 0.10 | 3 | This Invention |
| 5 | 5 | 0.10 | 3 | This Invention |
| 6 | 3 | 0.12 | 3 | This Invention |

As is apparent from the results in Table 5, it is noticed that, according to the processings of the present invention, excellent results in less bleach-fogging and in good desilvering can be obtained. In particular, most excellent result can be obtained at the ratio of Fe (II) complex being in the range of 5 to 20%.

EXAMPLE 6

A multilayer color photographic paper was prepared, on a base paper polyethylene-laminated on both sides and then treated by corona discharge, by providing a gelatin undercoated layer containing sodium dodecylbenzenesulfonate and photographic layers composed the following layer compositions. Coating solutions were prepared as follows:

Preparation of the first layer coating solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and each 4.1 g of solvents (Solv-3) and (Solv-7) were added and dissolved. Emulsified dispersion A was prepared by dispersing and emulsifying the above-obtained solution in 185 ml of 10% aqueous gelatin solution containing 8 ml of sodium dodecylbenzenesulfonate. Separately silver chlorobromide emulsion A (a mixture in silver molar ratio of 3:7 of large size cubic grain emulsion A having 0.88 μm of average grain size and small size cubic grain emulsion A having 0.70 μm of average grain size, respectively having 0.08 and 0.10 of deviation coefficient of grain size distribution, and both having 0.3 mol % of silver bromide localized on the part of grain surface) was prepared. In this emulsion blue-sensitive sensitizing dyes A and B shown below were added in an amount of $2.0\times10^{-4}$ mol to the large size grain emulsion A and $2.5\times10^{-4}$ mol to the small size grain emulsion A, respectively. The chemical ripening of this emulsion was carried out by adding a sulfur-sensitizing agent and a gold-sensitizing agent. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first layer coating solution. As a gelatin hardener for the respective layers, sodium salt of 1-oxy-3,5-dichloro-s-triazine was used.

Cpd-10 and Cpd-11 were added in each layer in a total amount of 25.0 mg/m$^2$ and 50.0 mg/m$^2$, respectively.

In the silver chlorobromide emulsion of each photosensitive emulsion layer, the following sensitizing dyes were used, respectively.

Sensitizing dye A for blue-sensitive emulsion layer

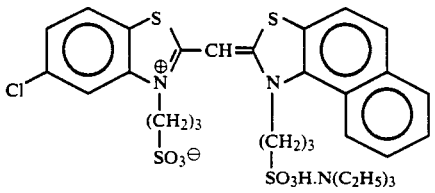

Sensitizing dye B for blue-sensitive emulsion layer

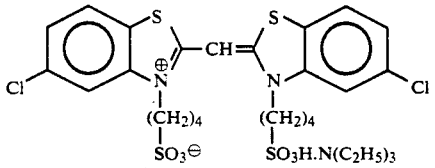

(each $2.0\times10^{-4}$ mol for the large size emulsion A and $2.5\times10^{-4}$ mol for the small size emulsion A, per mol of silver halide)

Sensitizing dye C for green-sensitive emulsion layer

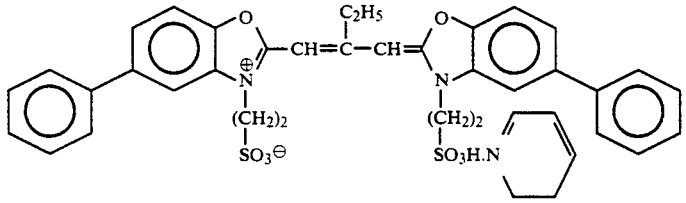

($4.0\times10^{-4}$ mol for the large size emulsion B and $5.6\times10^{-4}$ mol for the small size emulsion B, per mol of silver halide), and Sensitizing dye D for green-sensitive emulsion layer

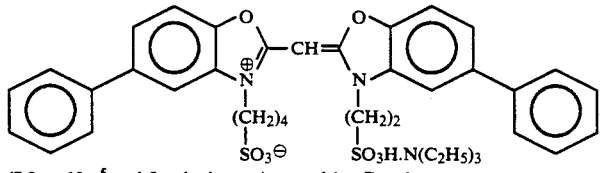

($7.0\times10^{-5}$ mol for the large size emulsion B and $1.0\times10^{-5}$ mol for the small size emulsion B, per mol of silver halide)

Sensitizing dye E for red-sensitive emulsion layer

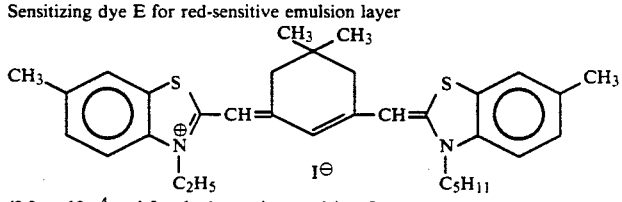

($0.9\times10^{-4}$ mol for the large size emulsion C and 1.1 × $10^{-4}$ mol for the small size emulsion C, per mol of silver halide)

To the red-sensitive emulsion layer, the following compound was added in an amount of $2.6\times10^{-3}$ mol per mol of silver halide:

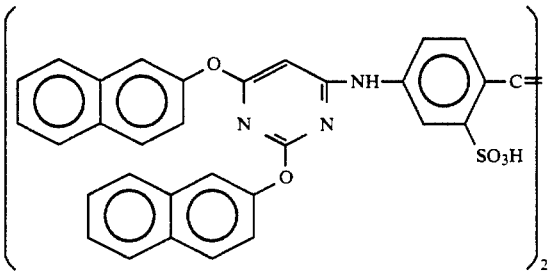

Further, to the blue-sensitive emulsion layer, the green-sensitive emulsion layer, and the red-sensitive emulsion layer, 1-(5-methylureidophenyl)-5-mercaptotetrazole was added in amounts of $8.5\times10^{-5}$ mol, $7.7\times10^{-4}$ mol, and $2.5\times10^{-4}$ mol, per mol of silver halide, respectively.

Further, to the blue-sensitive emulsion layer and the green-sensitive emulsion layer, 4-hydroxyl-6-methyl-1,3,3a,7-tetrazaindene was added in amounts of $1\times10^{-4}$ mol and $2\times10^{-4}$ mol, per mol of silver halide, respectively.

The following dyes (figures in parenthesis show coating amount) were added to emulsion layers to prevent irradiation.

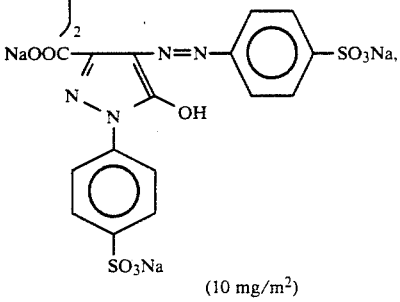

(10 mg/m²)

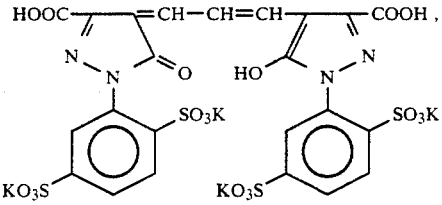

(10 mg/m²)

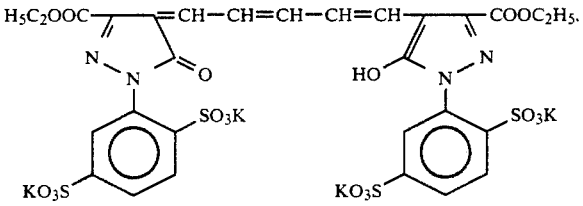

(40 mg/m²)

and

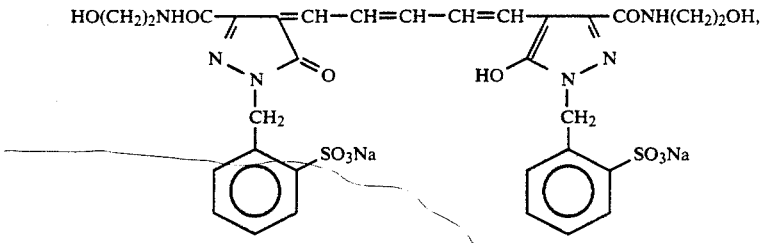

(20 mg/m²)

Composition of layers

The composition of each layer is shown below. The figures represent coating amount in g/m². The coating amount of silver halide emulsion is given in terms of silver.

| | |
|---|---|
| Supporting Base | |
| Paper laminated on both sides with polyethylene (a white pigment, $TiO_2$, and a bluish dye, ultramarine, were included in the first layer side of the polyethylene-laminated film) | |
| First layer (Blue-sensitive emulsion layer): | |
| The above-described silver chlorobromide emulsion A | 0.30 |
| Gelatin | 1.86 |
| Yellow coupler (ExY) | 0.82 |
| Image-dye stabilizer (Cpd-1) | 0.19 |
| Solvent (Solv-3) | 0.18 |
| Solvent (Solv-7) | 0.18 |
| Image-dye stabilizer (Cpd-7) | 0.06 |
| Second layer (Color-mix preventing layer): | |
| Gelatin | 0.99 |
| Color-mix inhibitor (Cpd-5) | 0.08 |
| Solvent (Solv-1) | 0.16 |
| Solvent (Solv-4) | 0.08 |
| Third layer (Green-sensitive emulsion layer): | |
| Silver chlorobromide emulsion (cubic grains, 1:3 (Ag molar ratio) mixture of large size grain emulsion B having 0.55 μm of average grain size and small size grain emulsion B having 0.39 μm of average grain size, respectively having 0.10 and 0.08 of deviation coefficient of grain size distribution, and both having 0.8 mol % of AgBr localized on the part of grain surface) | 0.12 |
| Gelatin | 1.24 |
| Magenta coupler (ExM) | 0.23 |
| Image-dye stabilizer (Cpd-2) | 0.03 |
| Image-dye stabilizer (Cpd-3) | 0.16 |
| Image-dye stabilizer (Cpd-4) | 0.02 |

-continued

| | |
|---|---|
| Image-dye stabilizer (Cpd-9) | 0.02 |
| Solvent (Solv-2) | 0.40 |
| Fourth layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth layer (Red-sensitive emulsion layer): | |
| Silver chlorobromide emulsion (cubic grains, 1:4 (Ag molar ratio) mixture of large size grain emulsion C having 0.58 μm of average grain size and small size grain emulsion C having 0.45 μm of average grain size, respectively having 0.09 and 0.11 of deviation coefficient of grain size distribution, and both having 0.6 mol % of AgBr localized on the part of grain surface) | 0.23 |
| Gelatin | 1.34 |
| Cyan coupler (ExC) | 0.32 |
| Image-dye stabilizer (Cpd-2) | 0.03 |
| Image-dye stabilizer (Cpd-4) | 0.02 |
| Image-dye stabilizer (Cpd-6) | 0.18 |
| Image-dye stabilizer (Cpd-7) | 0.40 |
| Image-dye stabilizer (Cpd-8) | 0.05 |
| Solvent (Solv-6) | 0.14 |
| Sixth layer (Ultraviolet absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

R = 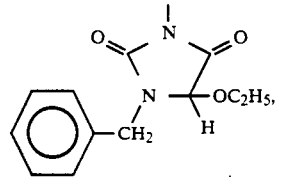 X = Cl and

R = 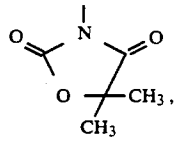 X = $OCH_3$ of

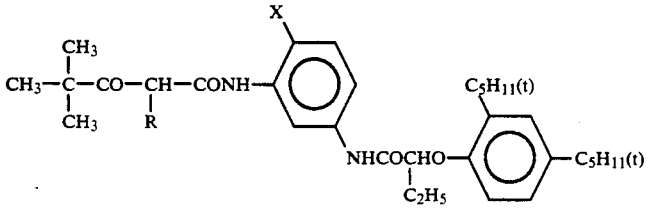

(ExM) Magenta coupler

-continued
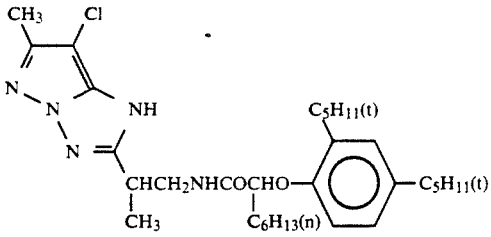
(ExC) Cyan coupler
Mixture (1:1 in molar ratio) of
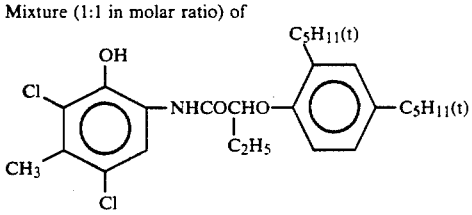
and
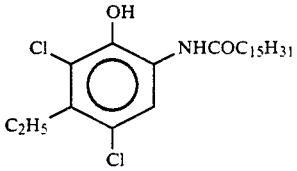
(Cpd-1) Image-dye stabilizer
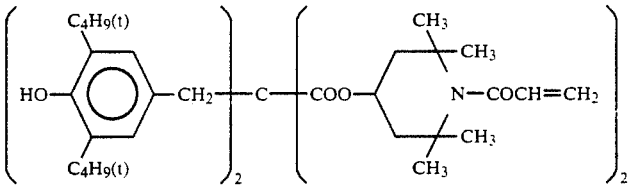
(Cpd-2) Image-dye stabilizer
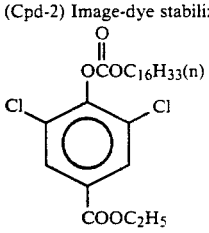
(Cpd-3) Image-dye stabilizer
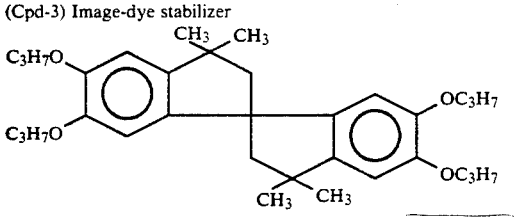
(Cpd-4) Image-dye stabilizer
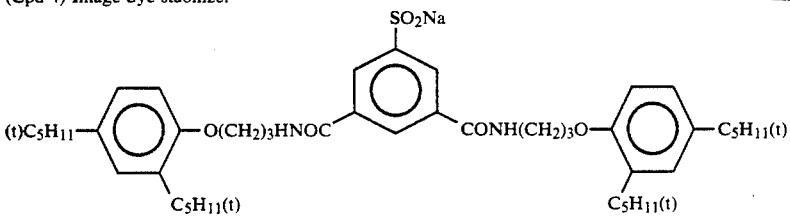
(Cpd-5) Color-mix inhibitor -continued
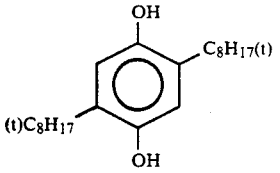
(Cpd-6) Image-dye stabilizer
Mixture (2:4:4 in weight ratio) of
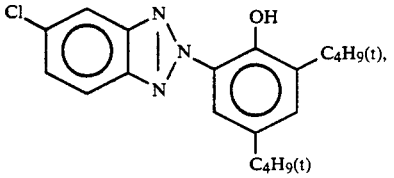
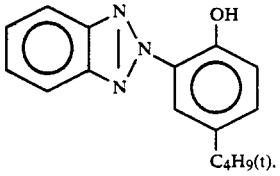
and
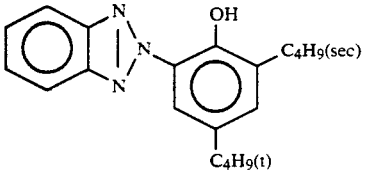
(Cpd-7) Image-dye stabilizer
$$\left(CH_2-\underset{\underset{CONHC_4H_9(t)}{|}}{CH}\right)_n$$
Average molecular weight: 60,000
(Cpd-8) Image-dye stabilizer
Mixture (1:1 in weight ratio) of
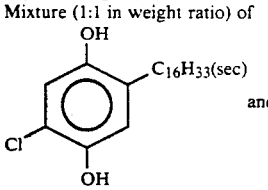
and
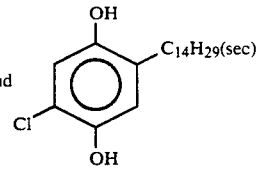
(Cpd-9) Image-dye stabilizer
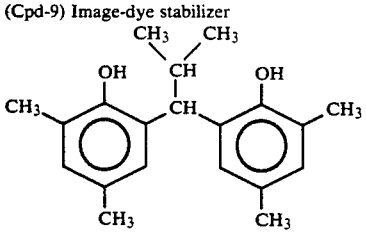
(Cpd-10) Antiseptics
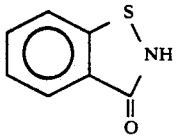
(Cpd-11) Antiseptics
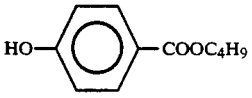
(UV-1) Ultraviolet ray absorber
Mixture (4:2:4 in weight ratio) of -continued

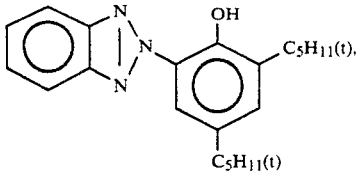

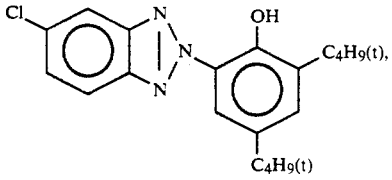

and

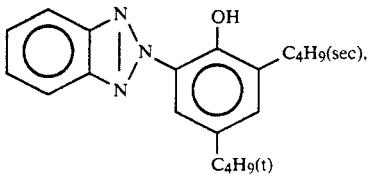

(Solv-1) Solvent

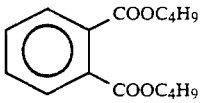

(Solv-2) Solvent
Mixture (1:1 in volume ratio) of

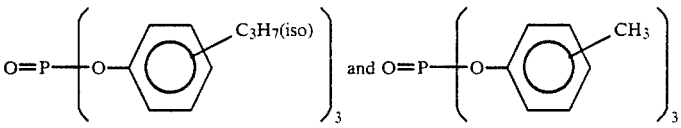

(Solv-3) Solvent
$O{=}P{+}O{-}C_9H_{19}(iso)]_3$ (Solv-4) Solvent

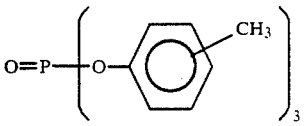

(Solv-5) Solvent

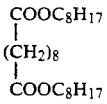

(Solv-6) Solvent
Mixture (80:20 in volume ratio) of

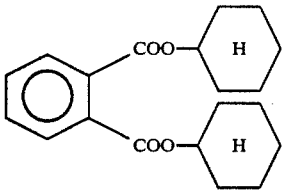

and $C_8H_{17}CHCH(CH_2)_7COOC_8H_{17}$
O (Solv-7) Solvent
$C_8H_{17}CHCH(CH_2)_7COOC_8H_{17}$
O First, The thus-prepared sample was subjected to a gradation exposure to light through three separated color filters for sensitometry by using a sensitometer (FWH-type made by Fuji Photo Film Co., Ltd., color temperature at light source: 3,200K). The exposure was conducted to give an exposure time of one tenth second and an exposure amount of 200 CMS.

The exposed sample was subjected to a continuous processing (running test) according to the processing process and the composition of processing solutions, shown below, using a paper processer, until the replenishing amount of color developer reached two times volume of the tank of color developer.

| Process | Time (sec.) | Temperature (°C.) |
|---|---|---|
| Color developing | 45 | 35 |
| Water washing | 15 | 24–34 |
| Bleaching | 60 | 38 |
| Water washing | 45 | 24–34 |
| Fixing | 45 | 38 |
| Water washing | 90 | 24–34 |
| Drying | 60 | 70–90 |

Composition of respective processing bath are as follows:

| | Tank solution | Replenisher |
|---|---|---|
| Color developer | | |
| Water | 800 ml | 800 ml |
| Ethylenediamine-N,N,N,N-tetramethylenephophonic acid | 1.5 g | 2.0 g |
| Potassium bromide | 0.015 g | — |
| III-9 | 0.2 g | 0.2 g |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-anminoaniline sulfate | 5.0 g | 7.0 g |
| N,N-Bis(carboxymethyl)hydrazine | 4.0 g | 5.0 g |
| Sodium N,N-di(sulfoethyl)-hydroxylamine | 4.0 g | 5.0 g |
| Fluorescent brightening agent (WHITEX 4B, prepared by Sumitomo Chem. Ind.) | 1.0 g | 2.0 g |
| Water to make | 1,000 ml | 1,000 ml |
| pH (25° C.) | 10.05 | 10.45 |
| Bleaching solution | | |
| Species and amount of bleaching agent to be added were changed and experiment was conducted in respective case. | | |
| Water | 600 ml | |
| Bleaching agent | See Table 6 | |
| 1,3-Propanediaminetetraacetic acid | 2 g | |
| Potassium bromide | 24 g | |
| Nitric acid | 5 g | |
| Water to make | 1,000 ml | |
| pH | 5.0 | |
| Fixing solution | | |
| Water | 600 ml | |
| Sodium thiosulfate | 100 g | |
| Sodium sulfite | 15 g | |
| Disodium ethylenediaminetetraacetate | 2 g | |
| Water to make | 1,000 ml | |
| pH | 7.0 | |
| Rinsing solution | | |
| (Both tank solution and replenisher) | | |
| Ion-exchanged water (concentrations of calcium and magnesium are both 3 ppm or below) | | |

The processed samples were subjected to a test for determination of yellow minimum density at unexposed part by Macbeth system to evaluate bleach-fogging. And the amount of residual silver at maximum density part (10 CMS) was measured by fluorescent X-ray. Results are shown in Table 6.

TABLE 6

| Treatment No. | Bleaching agent Species* | Bleaching agent Amount mol/l | Water-washing immediately after color-developing | Dmin | Amount of residual silver g/m² | Remarks |
|---|---|---|---|---|---|---|
| B2 | EDTA | 0.04 | Done | 0.09 | 0.13 | This Invention |
| B4 | DTPA | 0.02 | Done | 0.09 | 0.13 | This Invention |
| B6 | DTPA | 0.04 | Done | 0.09 | 0.12 | This Invention |
| B8 | DTPA | 0.10 | Done | 0.10 | 0.10 | This Invention |
| B10 | PDTA | 0.02 | Done | 0.09 | 0.04 | This Invention |
| B12 | PDTA | 0.04 | Done | 0.09 | 0.02 | This Invention |
| B14 | PDTA | 0.10 | Done | 0.09 | 0.03 | This Invention |

Note:
*EDTA:Fe(III) ammonium ethylenediaminetetraacetate
DTPA:Fe(III) ammonium diethylenetriamineheptaacetate
PDTA:Fe(III) ammonium 1,3-propanediaminetetraacetate As is apparent from the results in Table 6, good color image was obtained according to the method of the present invention. Further, in such processing as this, good results can be obtained by using polymer compounds of the present invention.

EXAMPLE 7

Experiment shown below was carried out on the coating sample 201 prepared in Example 2 by using color developer and bleach-fixing solution described hereinafter.

The above sample was processed by the following processing process using processing solutions compositions of which are shown below.

| Processing process | Temperature (°C.) | Time (sec) |
|---|---|---|
| Color developing | 38 | 45 |
| Bleach-fixing | 30–36 | 45 |
| Rinsing (1) | 30–37 | 30 |
| Rinsing (2) | 30–37 | 30 |
| Rinsing (3) | 30–37 | 30 |
| Drying | 70–80 | 60 |

Composition of each processing solution is as follows:

| | |
|---|---|
| Color developer | |
| Water | 800 ml |
| Additive (III-9)* | 0.15 g |
| Ethylenediaminetetraphophnic acid | 9.4 g |
| Diethylenetriamineheptaacetic acid | 1.2 g |
| 1-Hydroxyethylidene-1,1-diphosphnic acid | 0.6 g |
| Triethanolamine | 15.0 g |
| Sodium chloride | 3.0 g |
| Potassium bromide | 0.02 g |
| Potassium carbonate | 25 g |
| N-ethyl-N-(β-methanesulfonamidoethyl)-3-methyl-4-aminoaniline sulfate | 5.0 g |
| Organic preservative (I-17) | 0.05 mol |
| Sodium sulfite | 0.10 g |
| Fluorescent brightening agent (WHITEX 4B, prepared by Sumitomo Chem. Ind.) | 1.0 g |
| Water to make | 1,000 ml |
| pH (25 °C.) | 10.00 |

-continued

*III-9

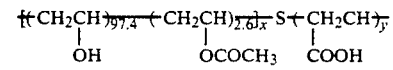

x:y = 5:1
(in weight)

Bleach-fixing solution

The ratio of Fe (II) and pH were changed as shown in Table 7.

| | |
|---|---|
| Water | 600 ml |
| Sodium thiosulfate (70%) | 100 ml |
| Fe(III) ammonium ethylenediaminetetraacetate and Fe(II) ammonium ethylenediaminetetraacetate | 0.14 mol |
| Disodium ethylenediaminetetraacetate | 5 g |
| Ammonium bromide | 40 g |
| Glacial acetic acid | 9 g |
| Water to make | 1,000 ml |
| pH (25°C.) | See Table 7 |

Rinsing solution

Ion-exchanged water (concentrations of calcium and magnesium are each 3 ppm or below)

The above-described color developer was aged at a constant temperature of 40° C. for 25 days in a condition wherein an opened area to be contacting to air was 20 $cm^2$ per 1 liter of the color developer.

The coated sample was subjected to a gradation exposure to light for sensitometry by using a sensitometer (FWH-type made by Fuji Photo Film Co., Ltd., color temperature at light source: 3,200K). The exposure was conducted by an exposure time of one tenth second and an exposure amount of 200 CMS.

After the lapse of time for the color developer the sample for sensitometry above described was treated, and the minimum density of yellow and the maximum density cyan were measured by Macbeth densitometer. Results are shown in Table 7.

TABLE 7

| Treatment No. | pH of bleach-fixing solution | Fe(II) % | Yellow Dmin | Cyan Dmax | Remarks |
|---|---|---|---|---|---|
| 1 | 4.5 | 25 | 0.105 | 2.58 | This Invention |
| 2 | 5.0 | 25 | 0.094 | 2.65 | This Invention |
| 3 | 5.5 | 25 | 0.089 | 2.75 | This Invention |
| 4 | 6.0 | 25 | 0.089 | 2.76 | This Invention |
| 5 | 6.5 | 25 | 0.090 | 2.76 | This Invention |
| 6 | 7.0 | 25 | 0.095 | 2.76 | This Invention |
| 7 | 7.5 | 25 | 0.105 | 2.75 | This Invention |
| 8 | 4.5 | 0 | 0.109 | 2.69 | This Invention |
| 9 | 4.5 | 40 | 0.108 | 2.50 | This Invention |
| 10 | 6.0 | 0 | 0.098 | 2.78 | This Invention |
| 11 | 6.0 | 5 | 0.090 | 2.77 | This Invention |
| 12 | 6.0 | 20 | 0.088 | 2.77 | This Invention |
| 13 | 6.0 | 35 | 0.089 | 2.77 | This Invention |
| 14 | 6.0 | 40 | 0.099 | 2.71 | This Invention |
| 15 | 7.5 | 0 | 0.105 | 2.76 | This Invention |
| 16 | 7.5 | 40 | 0.104 | 2.76 | This Invention |

As is apparent from the results in table 7, among the treatments of the present invention, when the pH of bleach-fixing solution is in a range of 5 to 7 and the ratio of Fe(II) complex to the total amount of Fe-complexes is in a range of 3 to 30%, the minimum density of yellow is low the resulting whiteness being particularly high and, at the same time, the maximum density of cyan is high.

It is apparent that the pH of bleach-fixing solution of 5 to 6 and the ratio of Fe(II) complex of 5 to 30% are particularly preferable in the treatment of the present invention.

Having described our invention as related to the embodiment, it is our intention that the invention be not limited by any of the detail of the description, unless otherwise specified, but rather be construed broadly within its spirit and scope as set out in the accompanying claims.

What we claim is:

1. A composition for color-development which comprises at least one aromatic primary amine color developing agent, at least one of compounds represented by the below-mentioned formula (I) or (II), and at least one polymer selected from the group consisting of a vinyl alcohol homopolymer, and a vinyl alcohol copolymer, and that is substantially free from sulfite ions:

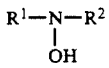

Formula (I)

wherein $R^1$ and $R^2$ each represent a hydrogen atom, an alkyl group, an alkenyl group, an aryl group, or a heteroaromatic group, and $R_1$ and $R_2$ are not hydrogen atoms at the same time and they may bond each other together with the nitrogen atom to form a heterocyclic ring,

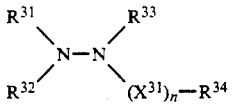

Formula (II)

wherein $R^{31}$, $R^{32}$, and $R^{33}$ each represent a hydrogen atom, an alkyl group, an aryl group, or a heterocyclic group, $R^{34}$ represents a hydroxyl group, a hydroxyamino group, an alkyl group, an aryl group, a heterocyclic group, an alkoxy group, an aryloxy group, a carbamoyl group, or an amino group, and $X^{31}$ represents a bivalent group selected from —CO—, —$SO_2$—,

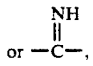

and n is 0 or 1.

2. The composition for color-development as claimed in claim 1, wherein the compound represented by formula (I) is the compound having the following formula (I-a):

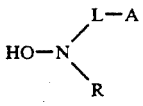

Formula (I-a)

wherein L represents an alkylene group, A represents a carboxyl group, a sulfo group, a phosphono group, a phosphinic acid residue, a hydroxyl group, an amino group, an ammonio group, a carbamoyl group, or a sulfamoyl group, and R represents a hydrogen atom or an alkyl group.

3. The composition for color-development as claimed in claim 1, wherein $R^1$ and $R^2$ in formula (I) each represent an alkyl group or an alkenyl group.

4. The composition for color-development as claimed in claim 1, wherein $R^{31}$, $R^{32}$, and $R^{33}$ in formula (II) each represent a hydrogen atom or an alkyl group.

5. The composition for color-development as claimed in claim 1, wherein $R^{34}$ in formula (II) represents an alkyl group, an aryl group, an alkoxy group, a carbamoyl group, or an amino group.

6. The composition for color-development as claimed in claim 1, wherein the amount of compound represented by formula (I) or (II) present is 0.005 mol to 0.5 mol per liter of the composition for color-development.

7. The composition for color-development as claimed in claim 1, wherein the amount of compound represented by formula (I) or (II) present is 0.03 mol to 0.1 mol per liter of the composition for color-development.

8. The composition for color-development as claimed in claim 1, wherein the molecular weight of polymer present in the composition for color-development is 1,000 to 56,000.

9. The composition for color-development as claimed in claim 1, wherein the polymerization degree of polymer present in the composition for color-development is 200 to 2,000.

10. The composition for color-development as claimed in claim 1, wherein a homopolymer or copolymer containing vinyl alcohol or vinylpyrrolidone in an amount of 40 mol % or more is present.

11. The composition for color-development as claimed in claim 1, wherein a vinylpyrrolidone homopolymer or a vinylpyrrolidone copolymer is present.

12. The composition for color-development as claimed in claim 1, wherein the amount of polymer present in to the composition for color-development is 0.05 g/l to 2 g/l.

13. The composition for color-development as claimed in claim 1, wherein the composition for color-development is substantially free from benzyl alcohol.

14. A method for processing a silver halide color photographic material, which comprises processing a silver halide color photographic material that has been exposed to light imagewise with a color developing composition comprising at least one aromatic primary amine color developing agent, at least one of compounds represented by the below-mentioned formula (I) or (II), and at least one polymer selected from the group consisting of a vinyl alcohol homopolymer and a vinyl alcohol copolymer, and being substantially free from sulfite ions:

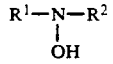

Formula (I)

wherein $R^1$ and $R^2$ each represent a hydrogen atom, an alkyl group, an alkenyl group, an aryl group, or a heteroaromatic group, and $R_1$ and $R_2$ are not hydrogen atoms at the same time and they may bond each other together with the nitrogen atom to form a heterocyclic ring,

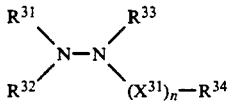

Formula (II)

wherein $R^{31}$, $R^{32}$, and $R^{33}$ each represent a hydrogen atom, an alkyl group, an aryl group, or a heterocyclic group, $R^{34}$ represents a hydroxyl group, a hydroxyamino group, an alkyl group, an aryl group, a heterocyclic group, an alkoxy group, an aryloxy group, a carbamoyl group, or an amino group, and $X^{31}$ represents a bivalent group selected from —CO—, —$SO_2$—, or

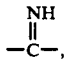

and n is 0 or 1.

15. The method for processing a silver halide color photographic material as claimed in claim 14, wherein the silver halide color photographic material comprises a silver halide emulsion layer of silver halide containing 80 mol % or more of silver chloride.

16. The method for processing a silver halide color photographic material as claimed in claim 14, wherein the silver halide color photographic material contains a lipophilic dispersion of coupler particulates which comprises at least one high-boiling organic solvent being substantially immiscible with water represented by formulae (A), (B), and (C):

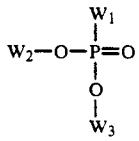

Formula (A)

Formula (B)

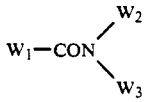

Formula (C)

wherein $W_1$, $W_2$, $W_3$ each represent an alkyl group, a cycloalkyl group, an alkenyl group, an aryl group or a heterocyclic group.

17. The method for processing a silver halide color photographic material as claimed in claim 14, wherein the process comprises processing the silver halide color photographic material after the color developing, in a desilvering process using a bleaching solution containing a Fe (II) complex in an amount of 3 to 35% based on the total Fe complexes as a bleaching agent.

18. The method for processing a silver halide color photographic material as claimed in claim 14, wherein the process comprises processing the silver halide color photographic material after the color developing, in a desilvering process using a bleaching solution containing Fe (II) complex in an amount of 10 to 30% based on the total Fe complexes as a bleaching agent.

19. The method for processing a silver halide color photographic material as claimed in claim 14, wherein the process comprises processing the silver halide color photographic material after the color developing, in a desilvering process using a bleaching solution or a bleach-fixing solution having a pH of 5 to 6.

* * * * *